US011844999B2

(12) United States Patent
Schneider et al.

(10) Patent No.: US 11,844,999 B2
(45) Date of Patent: Dec. 19, 2023

(54) BILLIARD TABLE WITH DINING TABLE CONVERSION-TOP

(71) Applicants: Uwe Schneider, Cincinnati, OH (US); Janik Paul Schneider, Cincinnati, OH (US)

(72) Inventors: Uwe Schneider, Cincinnati, OH (US); Janik Paul Schneider, Cincinnati, OH (US)

(73) Assignee: Uwe Schneider, Cincinnati, OH (US)

( * ) Notice: Subject to any disclaimer, the term of this patent is extended or adjusted under 35 U.S.C. 154(b) by 87 days.

(21) Appl. No.: 17/234,791

(22) Filed: Apr. 19, 2021

(65) Prior Publication Data

US 2021/0346786 A1 Nov. 11, 2021

Related U.S. Application Data

(60) Provisional application No. 62/982,049, filed on May 5, 2020.

(51) Int. Cl.
*A63D 15/04* (2006.01)
*A63D 15/00* (2006.01)

(52) U.S. Cl.
CPC ..... *A63D 15/04* (2013.01); *A63D 15/003* (2013.01)

(58) Field of Classification Search
CPC ..... A63D 15/04; A63D 15/003
USPC ..... 473/10
See application file for complete search history.

(56) References Cited

U.S. PATENT DOCUMENTS 512,337 A * 1/1894 Standen ..... A63D 15/04 473/10
572,688 A * 12/1896 Seifert ..... A63D 15/04 473/14
747,097 A * 12/1903 Spalt ..... A63D 15/04 473/10
1,755,062 A * 4/1930 Hernes ..... A47B 25/00 473/109
1,926,486 A * 9/1933 Jones ..... A63D 15/04 473/10
2,008,613 A * 7/1935 Hernes ..... A47B 25/00 473/10
2,115,115 A * 4/1938 Matteson ..... A63D 15/04 473/14
3,048,459 A * 8/1962 Moore ..... A63D 15/04 108/90
3,941,378 A * 3/1976 Bagley ..... A63D 15/04 473/21
4,519,607 A * 5/1985 Schill ..... A63D 15/04 473/14
4,549,320 A * 10/1985 McGivern ..... A47C 17/62 473/10

(Continued)

FOREIGN PATENT DOCUMENTS

DE 102009003723 A1 * 10/2010 ..... A47B 3/0815
DE 202010016203 U1 * 5/2011 ..... A47B 3/00

*Primary Examiner* — Mitra Aryanpour

(57) ABSTRACT

An embodiment of an improved design of a billiard table set with a dining table conversion-top, containing a billiard table with movably attached dining top segments, designed to eliminate inconvenient removal and storage of removable tabletop segments. The billiard dining table set furthermore contains benches featuring a custom height adopted to enable comfortable seating and foldable legs that enable storage of the benches under the dining table. Other embodiments are described and illustrated.

14 Claims, 35 Drawing Sheets

(56) References Cited

U.S. PATENT DOCUMENTS

| | | | | | |
|---|---|---|---|---|---|
| 4,569,555 | A * | 2/1986 | Lehman | A47B 83/02 | 108/159 |
| 6,164,211 | A * | 12/2000 | Faris | A47B 85/06 | 108/11 |
| 6,616,141 | B2 * | 9/2003 | Diamant | A63D 15/04 | 473/10 |
| 6,712,711 | B1 * | 3/2004 | Skelton | A63D 15/04 | 473/10 |
| 6,766,747 | B1 * | 7/2004 | Wolfe | A47B 25/00 | 108/26 |
| 7,229,360 | B2 * | 6/2007 | Chevillotte | A63D 15/04 | 473/8 |
| 7,506,871 | B2 * | 3/2009 | Giegerich | A63B 69/0053 | 273/108 |
| 7,601,070 | B2 * | 10/2009 | Schmidt | A63D 15/04 | 473/10 |
| 7,972,219 | B1 * | 7/2011 | Voden | A63D 15/04 | 473/10 |
| 2005/0049056 | A1 * | 3/2005 | Padilla | A63D 15/04 | 473/10 |
| 2005/0255928 | A1 * | 11/2005 | Nally | A63D 15/04 | 473/10 |
| 2007/0155519 | A1 * | 7/2007 | Panzica | A63D 15/04 | 473/10 |
| 2012/0238373 | A1 * | 9/2012 | Chen | A63D 15/04 | 473/14 |
| 2017/0340100 | A1 * | 11/2017 | Tsai | A47C 11/00 | |

* cited by examiner

BILLIARD TABLE WITH DINING TABLE CONVERSION-TOP

FIELD OF THE INVENTION

The present invention relates to billiard tables and other game tables and more is specifically to billiard and other game tables with dining table conversion-tops. Although such tables have been available for many years, their dissemination remains limited as current designs compromise on functionality, ergonomics of use, esthetics and overall is user experience. The present invention provides improvements to address these shortfalls.

BACKGROUND OF THE INVENTION

Pool tables—often also referred to as billiard tables—are a favorite of family in-home entertainment, but they are more commonly found in public places like bars, restaurants or community recreation centers. One of the challenges associated to pool tables is their relatively large size and heavy weight. A full size pull table with sufficient clearance for playing around its perimeter may occupy a room of at least 17 by 14 feet and may weigh more than 600 pounds. Furthermore, a pool table needs to be installed at nearly perfect level. Due to these requirements pool tables have to be installed in a dedicated space and cannot be moved around easily. However, space in residential homes is precious and consequently pool tables are typically not installed in preferred locations of family homes such as living or dining rooms, and the game of pool is consequently played less often than the popularity of the game would suggest. A known solution are so-called conversion-top pool tables. Such pool tables feature removable tabletops that can be installed on top of the pool tables playing surface, allowing to change the pool table to a large size dining table and enabling dual use of the space they occupy. However, there are some remaining challenges which makes the use of currently known designs of conversion-top pool tables inconvenient and hence negatively impact the overall user experience. As such conversion-top pool table remain a niche product that can be only found in few homes. The subject of the present invention is a conversion-top pool table addressing key limitations of current designs and enabling the expanded use of conversion-top pool tables in popular living spaces of private residences and in public spaces. Such improved conversion-top pool tables may be used in any space where the dual functionality—the use as pool table and the secondary use as a large table, such as a dining table—is a desirable feature. Further improvements such as lightweight construction of the tabletops, a compact ball collector pocket design and integrated pool cue storage are being described.

SUMMARY OF THE INVENTION

The present invention is directed towards pool tables with conversion dining tops. In one embodiment the table features movably attached tabletop segments that can easily be moved from a first location—the dining position—to a second location—the playing position. The tabletop segments nest under the table in an esthetically pleasing arrangement while vacant space under the table may be utilized to store seats such as foldable benches or chairs. In another embodiment the table may feature both movably attached and removable tabletop segments. In yet another embodiment the invention features tabletop segments that are foldable to enable a more compact collapsed arrangement. To enable uncompromised functionality as dining table and pool table the height of the table, the height of the seats, and the clearance under the table need to be coordinated through specific design choices. The following detailed description provides an overview of the most relevant considerations to enable an improved design.

A SHORT DESCRIPTION OF THE DRAWINGS

FIG. 1—shows a sectional cut view of a generic conversion-top pool table and defines the essential parts and critical dimensions described (Prior Art)

FIG. 2A—shows a sectional view of one embodiment of the current invention—a reduced height stack-up of the upper table assembly FIG. 2B—shows a side view of a conversion-top pool table according to the present invention. The left side of the figure illustrates the open (playing) position, while the right side of the figure illustrates the closed (dining) position FIG. 3A—is an isometric view of the a dining pool table in playing position FIG. 3B—is an isometric view of the a dining pool table in dining position FIG. 3C—is a side view of the a dining pool table in dining position FIG. 3D—is a side view of the a dining pool table in an interim position with one tabletop segment moving from the dining to the playing position FIG. 3E—is a side view of the a dining pool table in playing position FIG. 3F—shows an isometric view of a segmented tabletop design with foldable sub-segments of the tabletop.

FIG. 3G—shows a side view of the dining pool table shown in FIG. 3F with the left side of the table in playing position and the right side of the table in dining position.

FIG. 3H—shows a side view of the dining pool table shown in FIG. 3F in an interim position between playing and dining position.

FIG. 3I—shows a sectional view of a 5-piece tabletop design, with 4 trapezoidal movably attached segments and one removable tabletop center segment.

FIG. 3J—shows a isometric view of the table shown in FIG. 3I in dining position FIG. 3K—shows an isometric view of the table with the side segments folded down and the removable center segment still resting on the playing surface of the pool table.

FIG. 3L—shows an isometric view of the table in playing position with the tee removable center segment removed, defining the playing position.

FIG. 3M—is a side view of the table in playing position.

FIG. 3N—shows a table with Mono-leg design featuring under-table storage compartments. It shows an isometric view of the table in dining position with 1 bench setup.

FIG. 3O—shows a side view of the table in playing position with 4 folding benches inserted in the storage compartment.

FIG. 3P—shows an isometric view of a conversion-top dining table according to one embodiment of the invention featuring foldable tabletop segments and is shown in an interim position with one side of the tabletop segments in playing position while the other side is shown in the dining position.

FIG. 3Q—shows another isometric view of the table shown in FIG. 3P from a lower angle FIG. 4A—shows an examples of a foldable bench setup with a conversion-top pool table (shown in dining position)

FIG. 4B—a top view of a seating arrangement with 6 folding benches around a dining pool table.

FIG. 4C shows a top view of 2 long benches and 4 stools arranged around a dining top pool table.

FIGS. 4D—shows an example of a bench featuring foldable legs with legs folded out FIGS. 4E—shows an example of a bench featuring foldable legs with legs folded in FIG. 5A—shows an isometric view of a preferred embodiment of the invention FIG. 5B—shows a top view of a preferred embodiment of the invention FIG. 5C—shows a sectional view of a preferred embodiment of the invention in two different positions: The left side of the figure shows the tabletop segments in playing position, while the right side of the figure shows the tabletop segments in dining position.

FIG. 5D—shows a sectional view of a preferred embodiment of the invention in two different positions: The left side of the figure shows the tabletop segments in an interim position rotating up from the storage position under the upper pool table assembly, while the right side of the figure shows the long trapezoidal tabletop segment in dining position, while the rectangular tabletop segment is rotated open and resting on top of the long trapezoidal tabletop segment.

FIG. 5E—shows an isometric view of a preferred embodiment of the invention in a partially converted interim position FIG. 5F—shows an isometric view of the table in dining position with four benches arranged around the table FIG. 5G—shows an isometric view of a preferred embodiment of the invention with four nesting benches stored under the table in the playing position FIG. 6—shows a sectional view featuring a pool cue storage rack mounted to the underside of the tabletop. The left side of FIG. 6 is shown in playing position while the rights side of FIG. 6 is shown in the playing position.

LABELS AND DIMENSIONS/REFERENCE NUMERALS

Figure 1:
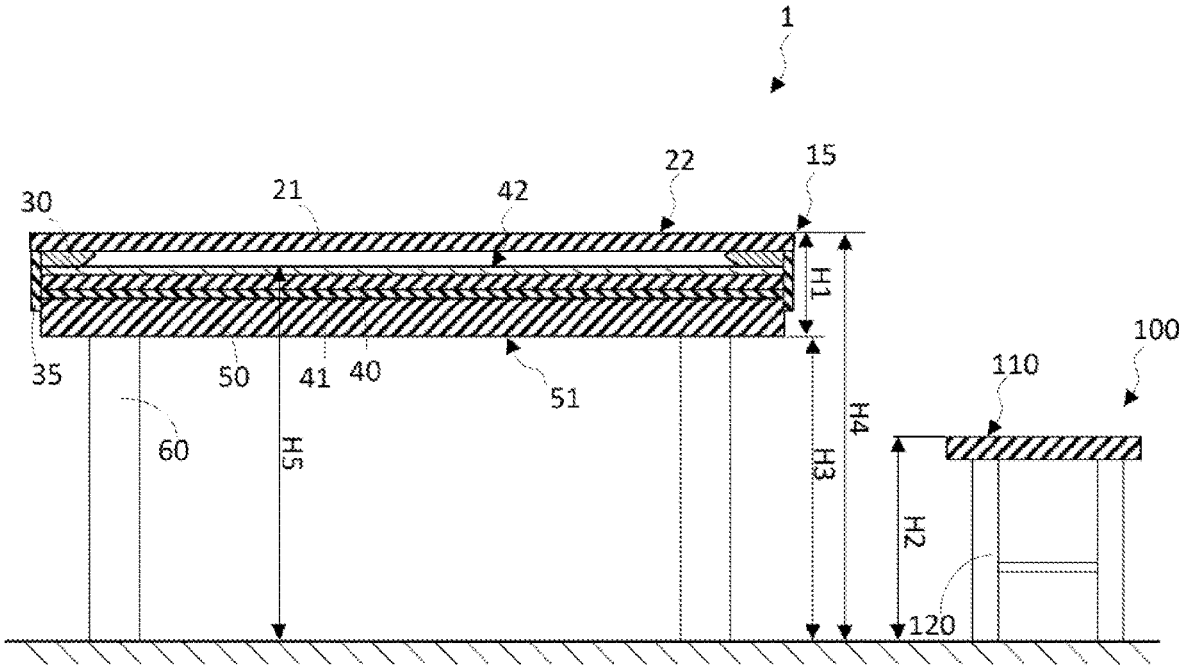

1—pool table with dining table conversion tabletop
10—hinge
11—linkage mechanism
12—location of hinges points
15—upper edge of tabletop
19—upper pool table assembly
20—tabletop
21—tabletop segment
22—dining surface
23—removable tabletop segment
25—long trapezoidal tabletop segment
26—short trapezoidal tabletop segment
27—rectangular tabletop segment
30—rails
35—apron
36—rotatable apron
40—slate
41—felt
42—playing surface
50—Support structure
51—lower elevation of upper table assembly
60—legs
62—outrigger legs
70—base plate
80—pool cue storage rack
100—seat
110—seating surface
120—foldable legs of bench
200—dining set
H1—Stack up height of upper table assembly
H1A—Stack up height of upper table assembly measured near the edge of the table
H1B—Stack up height of upper table assembly measured near the center of the table
H2—Height of seating surface measured from floor
H3—Height from floor to underside of upper table assembly
H4—Height of dining surface measured from floor. H4=H1+H3
H5—Height from floor to playing surface
A—The included angle of motion of the tabletop segments measured between their location in the dining position and their location in the playing position. A more detailed definition of the included angle is provided in the detailed description.

DETAILED DESCRIPTION OF THE INVENTION

Conversion-top pool tables have been known for many years. One example describing a conversion-top pool table can be found in US patent U.S. Pat. No. 3,941,378A. Some currently popular models of conversion-top pool tables include the Albany Dining Pool table available from Ozone Billiards, the Hudson Dining Pool table available from Spencer Marston and the Penelope with Dining Top available from Imperial Billiards.

These pool table designs commonly feature a standard sized pool table and a segmented tabletop. The tabletop (20) will cover the entire playing surface including the side rails (30) of the pool table, when converted and enabling its use as dining table. The tabletop typically consists of multiple segments (21), to make the size and weight of the tabletop more manageable for removal and installation. It can be appreciated that a non-segmented tabletop would be too large and too heavy to maneuver around as the table gets converted from dining table to pool table. The tabletop segments (21) are being laid flat, side by side, on top of the pool table playing surface and may have features to align the segments as well as mechanical alignment features or a rubbery high coefficient-of-friction material at some contacting surfaces at its underside to prevent the tabletop from sliding off the table. This also helps to avoid damages to the side rails or playing surface (42), often referred to as the slate (40) that is covered with billiard cloth, often referred to as the felt (41).

For example, the tabletop of the Penelope with Dining Top from Imperial Billiards features 4 separate segments. Each of the 4 segments measures approximately 54 inches by 23 inches and weighs about 28 lbs. If the tabletop was not divided it would measure approximately 54 inches by 92 inches and weigh over 112 lbs. Although this known segmented design addresses the basic functionality requirement, the conversion in itself remains inconvenient. It requires to move 4 relatively large, heavy and detached tabletop segments. For practical purposes the removal or installation of the tabletop segments on such a table may be best handled as a "two-person job". Furthermore, when the table is used to play pool these relatively large and heavy tabletop segments need to be stored away somewhere. The storage of large tabletop segments along with the storage of multiple chairs, stools or benches—that are required for the use of the converted pool table as dining table may become a practical obstacle in itself. This may render the use of the device useless to some and compromises the functionality and convenience of use for others.

Dining top pool tables typically have removable tabletop segments, but in some cases tabletop segments may be movably attached. One example is the Shanghai Dining Pool Table by MBM Biliardi of Paliano, Italy. Regardless whether attached movable designs or removable segmented designs are applied for the tabletops, it is desirable to reduce the weight of the tabletops to improve maneuverability. In one embodiment of the present invention weight optimized designs may be applied that include construction using hollow extruded aluminum profiles, foamed aluminum, carbon fiber or other high-strength lightweight polymer compounds. Alternatively, lightweight wood fiber-based compounds such as a honeycomb core structure commonly used for doors and furniture may be applied. In one embodiment of the present invention the basis weight—i.e. the average weight per square area—for a lightweight tabletop should be equal or less than 7000 gsm (grams per square meter) when averaged over the full surface area of the tabletop. Hereby the average basis weight is calculated by dividing total weight by total area of the segment. For reference example the current design tabletop of the Penelope with Dining Top from Imperial Billiards has a total square area of 54 by 92 inches and weighs approximately 112 lbs. This results in a calculated average basis weight of about 15850 gsm, or more than double the specified 7000 of the preferred lightweight design. A lightweight tabletop design can more easily be handled by a single person and reduces the risk of injury by squishing fingers under the no weight of the tabletop segments. While the required strength and resistance to bending and buckling may dictate to maintain a certain minimum basis weight, to create a sturdy tabletop construction, for the purpose of the present invention it is only relevant that the basis weight does not exceed the described limit of 7000 gsm.

Figure 2A:
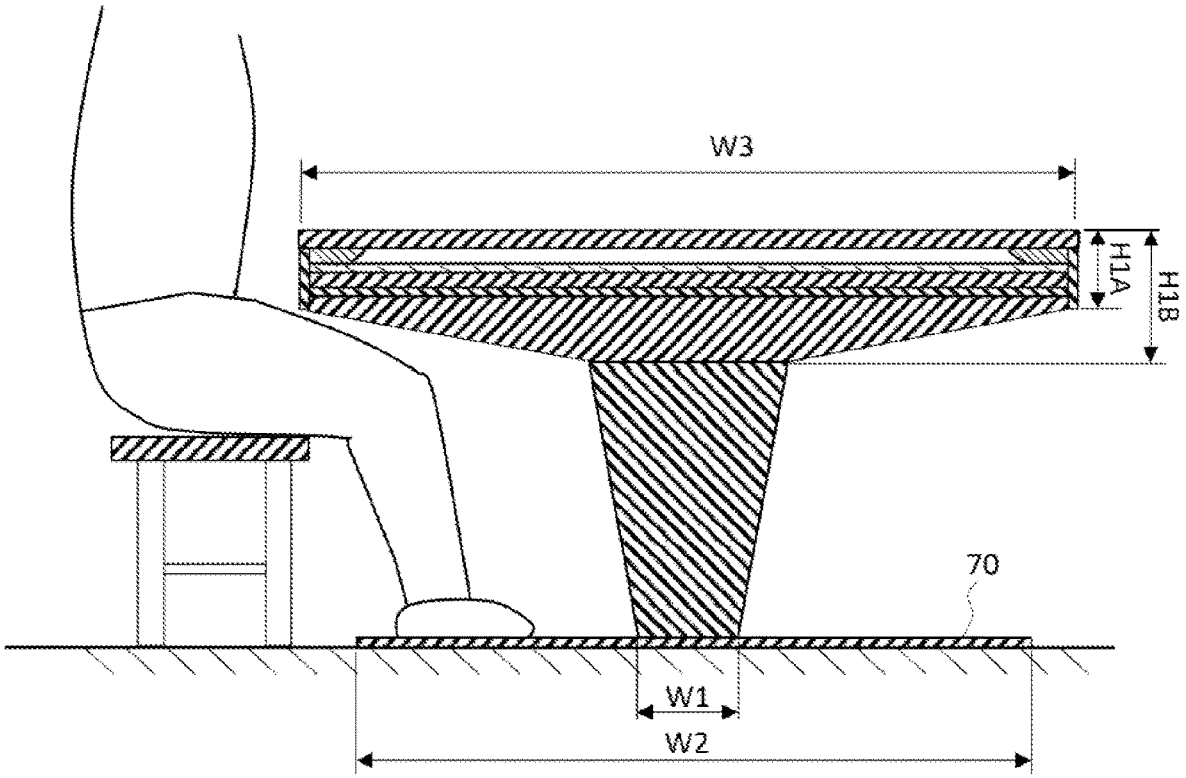

FIG. 2A shows another embodiment of the present invention where the total stack up height H1 of the upper table assembly (19) is minimized and the height of the seats H2 is adjusted as a function of the height of the tabletop H4 in order to enable comfortable seating.

The upper table assembly (19) for the purpose of the following description includes essentially all parts of the pool table assembly except the legs and base plate of the table. This includes but is not limited to the tabletop, the rails, the apron, the slate, the felt as well as the support structure.

For example, a typical dining table tabletop may be about 29 inches elevated off the floor and may be available in a variety of different sizes of length and width. Pool tables come in regulation sizes. The standard height of pool tables is published by World Pool-Billiard Association. It defines the standard height of the playing surface of a pool table H5 between 29¼ inches and 31 inches high when measured between the floor and the playing surface (42) of the pool table. The height of the rails (30) may be about 1¾ to 2 inches tall—as well as the height of the tabletop—often about ¾ to 1¼ inches thick—need to be considered for the total height H4 of the dining surface (22). As a result, the height H4 measured from the floor to the dining top surface (22) will be typically range around 32 to 34 inches. If the regulation height for the pool tables playing surface is maintained near regulation sizes, the height of the dining table surface (H4) will consequently be 3 to 5 inches higher in elevation that the typical 29 inch height of a common dining table.

Some previous attempts have been made to address this specific challenge by implementing height adjustability for pool tables. For example U.S. Pat. No. 6,102,808 describes one design of a pool table with height adjustability. However, the practical execution of such a table is very complex, given the before mentioned heavy weight and the very strict requirement of keeping the table nearly perfectly level. A functional design of a an pool table with height adjustability is technically challenging, hence expensive to execute and therefore less desirable.

In one embodiment of the current invention the described challenge is being addressed differently, and yet more efficiently than in a design that requires to adjust the height of the table. If a typical dining table has a height of 29 inches and is typically paired with standard height seats, such as benches, stools or chairs, of approximately 18 inches in height—measured from the floor to the seating surface (110)—a simple solution is to match a taller pool table with a set of taller seats to maintain the preferred height difference between tabletop and seating surface of approximately 11 inches. For example, a pool table with a dining top height of 34 inches may be paired with seats of approximately 23 inches in height, or a pool table with a dining top height of 32 inches may best be paired with seats of approximately 21 inches height. It needs to be appreciated that these measurements are approximate and that a height difference between tabletop and seat height in the range of 10 to 12 inches or maybe even in the range of 9 to 13 inches may still provide adequate comfort. However, if for example a pool table of 34 inches tabletop height is paired with seats of the common 19 inch standard height the use of the dining table is compromised, because the before mentioned height difference would now be 15 inches and as such is outside the defined preferred ranges of this embodiment.

In one embodiment a conversion-top pool table may be fabricated and sold as a complete dining set, containing the described conversation top pool table and a set of seats, such as chairs, stools or benches, which is matched in height—per the described ranges—and is furthermore matched in its design to the table to provide an esthetically pleasing dining set arrangement.

While the above-described method addresses one challenge of conventional conversion-top pool tables and avoids the need for height adjustability of the pool table, in one embodiment of the invention the stack up height of the tabletop needs to be minimized. Implementing a minimal height stack up (H1 per FIG. 1) of the upper table assembly (19) addresses the challenge of insufficient clearance under the pool table to provide sufficient leg room for a person sitting on the table and to enable comfortable seating. FIG. 1 illustrates the height stack up of a typical upper pool table assembly (19) consisting of support structure, possible interim layers, the slate, playing surface, the side rails and the tabletop. The total stack up height H1 of a conventional design will typically be 8 or more inches tall. Starting for example from a 33-inch-tall tabletop height and subtracting 8 or more inches for the typical stack up of a pool table—leaves a height H3 of 25 inches or less of clearance under the table. With an ideal ratio of tabletop height (H4) being roughly 10-12 inches taller than the seat height (H2), it should be appreciated that a person sitting on a 21-23-inch-tall seat cannot sit comfortable on a pool table featuring 25 inches or less of clearance under the table. This would only leave 2-4 inches of clearance and the person's legs will be wedged between the seat and the underside of the upper pool table assembly, making the use as dining table uncomfortable.

In one embodiment of the present invention the above-described challenge may be addressed by a design that minimizes the overall stack up height H1. In one embodiment the total stack up height of the upper table H1 would be designed to be 6 inches or less. While there are practical limitations for the minimum caliper of tabletop and slate, and there are strict requirements of the rail height, the height of the total stack up may most easily be minimized by an optimized design of the support structure (50). For example, the shape of the support structure may be adopted to match the required strength of support in a variable height profile across the area of the table. In one embodiment of the invention an arched or angled support structure as shown in FIG. 2A may be implemented. The caliper height measured near the outside of the table H1A may be lower than the caliper height measured near the center of the table H1B in order to support the table adequately. In such a design it needs to be appreciated that the stack up height H1A is the parameter relevant for the desired seating comfort, and as such should be 6 inches or less tall, while the height H1B near the center of the table may be larger than 6 inches as it would not interfere with the legs of a person sitting. Alternatively, a low height support structure may be constructed from high strength materials such as extruded aluminum profiles or steel tubing, enabling to minimize the total stack up height H1 to be limited to 6 inches or less. Such a design can eliminate the need for an arched or angled support structure.

Building on the concept described above where the stack-up height of the upper table at the outside edges (H1A) is minimized to 6 inches or less, another practical challenge arises that can be addressed by another embodiment of the present invention: A compact ball collector pocket design.

Each ball collector pocket of a pool table—where balls are dropped and collected during the game, should provide ideally space for at least 8 or more balls. As such a ball collector pocket will typically measure more than 5 inches in vertical height hanging down from the playing surface. A typical ball collector pocket is quite rigid as it is commonly made from leather or plastic. If the ball collector pocket extents below the lower elevation (51) of the upper table assembly (19), it can interfere with the legs of the person sitting in the location of the ball collector pocket when the table is used as dining table. In one embodiment a collapsible design of a ball collector pocket is implemented that may be made of foldable material such as a woven fabric. It may furthermore utilize a magnet, a sling, a hook or another feature to enable holding the pocket in an upper collapsed position when the table is used for dining to avoid the extension below the lower elevation (51) of the upper table assembly (19). Alternative to the collapsible ball collector pocket a reduced height ball pocket design may be implemented. Given that a billiard balls diameter is only 2% inches in diameter, it is possible to design a solid pool ball collector pocket that provides space for multiple balls side by side in a horizontal arrangement, while the pocket height itself would only need to be slightly taller than the ball diameter itself, 3 inches for example. For the purpose of the description both collapsible ball collector pockets and reduced height ball collector pockets will be referred to as compact ball collector pockets.

Figure 7A:
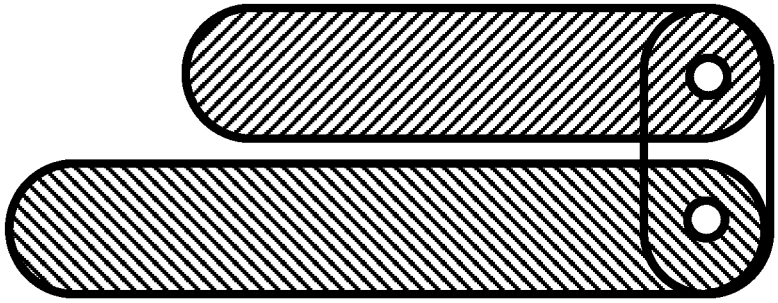
FIG. 7A shows schematic views of a double pin hinge design—as a sectional view in closed positions. The included Angle A is about 0 degree.
Figure 7B:
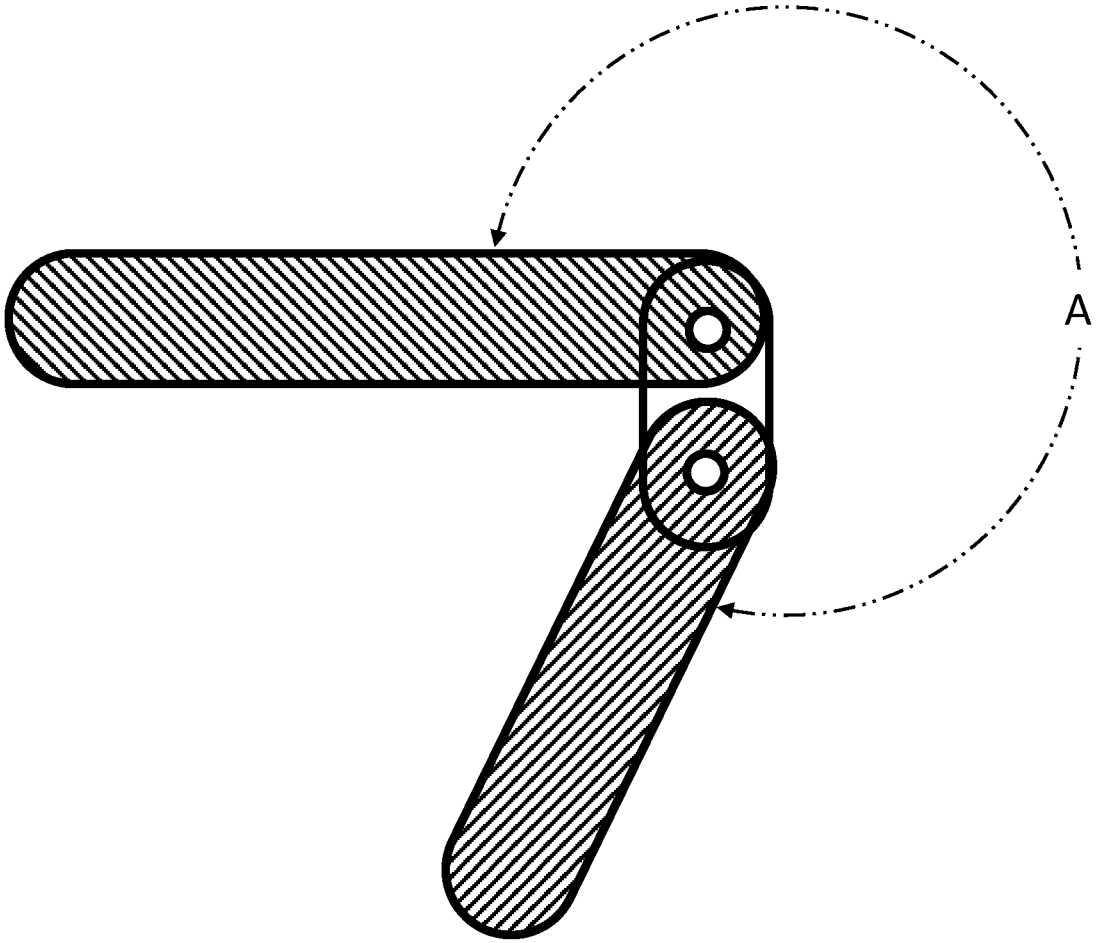
FIG. 7B shows the hinge of FIG. 7A in the open position. The included Angle A is over 280 degree.

In the main embodiment of the present invention the tabletop segments are being movably attached to the table. This may be achieved by the use of hinges (10). Special hinges—like for example the double pin hinge design shown in FIGS. 7A and 7B—may be required to enable sufficient clearance when the segments move and to avoid the hinge itself protruding beyond the surface of the tabletop when used as dining top, as this may be compromising the use as dining and pool table. Alternatively, hidden hinges may be deployed, such as the model TECTUS, a completely concealed hinge mechanism sold by company Simonswerk of Rheda, Germany. Furthermore, fabricated pivoting mechanisms, linkage mechanisms, a sliding mechanisms or combinations thereof may be deployed. The tabletop may be a segmented design, where all, or at least some of the segments, remain connected to the table and can be moved from a first position on top of the table, to form a dining top, and to a second position at the sides or underneath the table, to enable the use as a playing surface. This improves convenience of use, as it addresses the described storage challenge and it significantly reduces the effort required for the conversion.

The motion to move tabletop segments from the first to the second position comprises preferably a rotating or orbiting motion. Moving a segment can easily be done by one person and moving all the segments of a table may be completed in a matter of a few seconds. On the contrary, removing and storing away the heavy and large tabletop segments of conventional designs may require substantially more time, or may require involving more than 1 person.

The second position—the playing position—is the position where the movably attached tabletop segments reside during the use of the table to play pool. The second position for the tabletop segments is at the sides and preferably tucked underneath the table as shown for example in FIG. 2B. As indicated in the drawing this location is intended to avoid interference between a person standing close to the table trying to reach the playing surface and the folded down segments. The angle A describes the included angle between the first position and the second position when measured around the edge 15 of the table. The angle A in an embodiment of the invention is an angle A larger than 280 degree, preferably larger than 300 degree and most preferably larger than 315 degree. In that regard the present invention provides a distinguished advantage over existing designs of pool tables with rotatable tabletop segments. For examples the Shanghai Dining Pool Table by MBM Biliardi is designed to rotate the tabletop segments from the first position to a second position. However due to the interference with the legs of the table a rotation of more than about 270 degree is not possible. The embodiment of the present invention requires the legs (60) and the upper table assembly (19) of the pool table (1) to be designed in a way that they don't interfere with a tabletop segments when being moved from the dining into the playing position. Various designs of table legs and upper table assemblies that meet such requirement are included in FIGS. 3 (3A through 3Q) and 5 (5A through 5G). The common denominator and embodiment of the present invention is the characteristics that the legs of the table and upper table assembly design avoid interference with the tabletop segments when these are being moved from position 1 toward position 2 and where the angle A between position 1 and 2 as indicated in FIG. 2B is at least 280 degree.

Figure 2B:
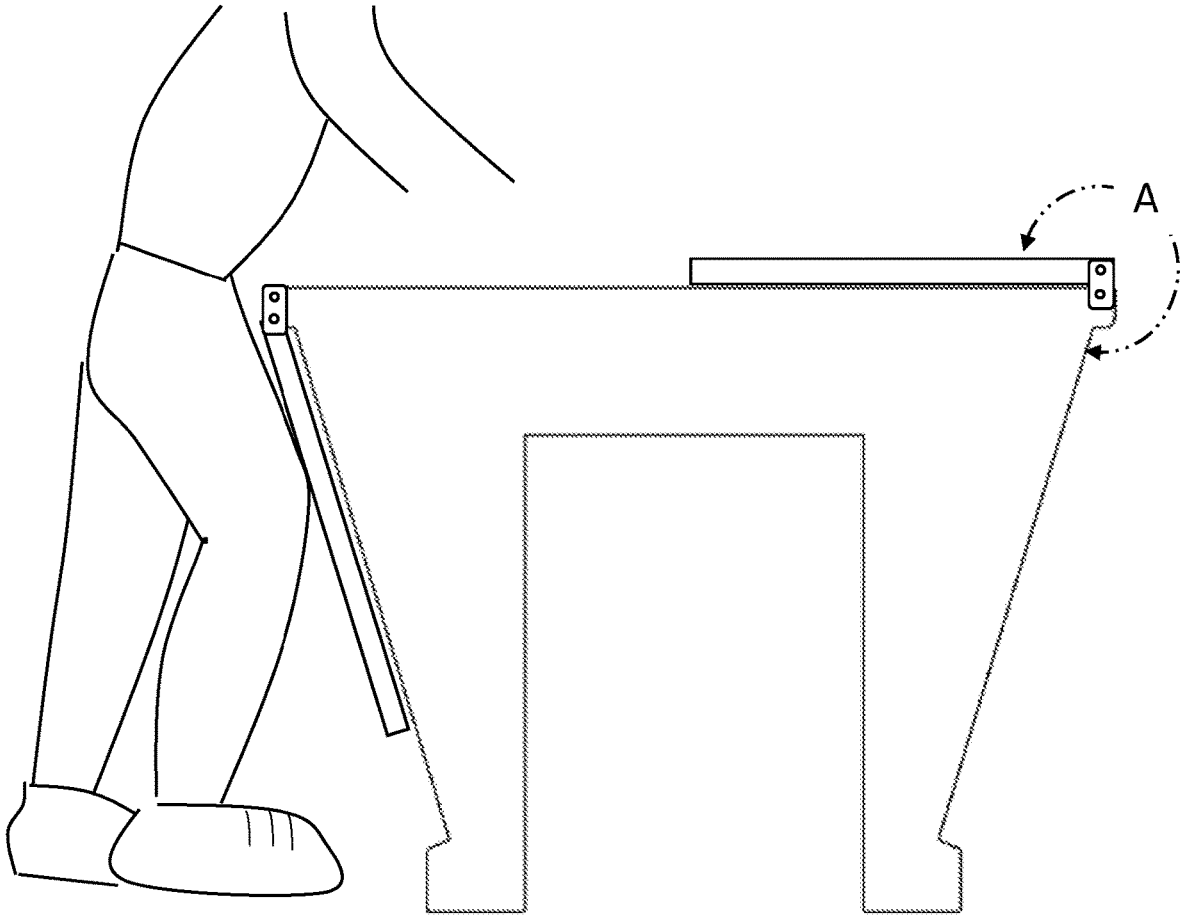

It should be noted that the second position that preferably requires the tabletop segments located underneath the upper table assembly allows the pool player to stand closer to the table—for example extending parts of his leg underneath the table, as shown in FIG. 2B. This can enable a more ergonomic standing position in certain positions during game play.

Figure 3A:
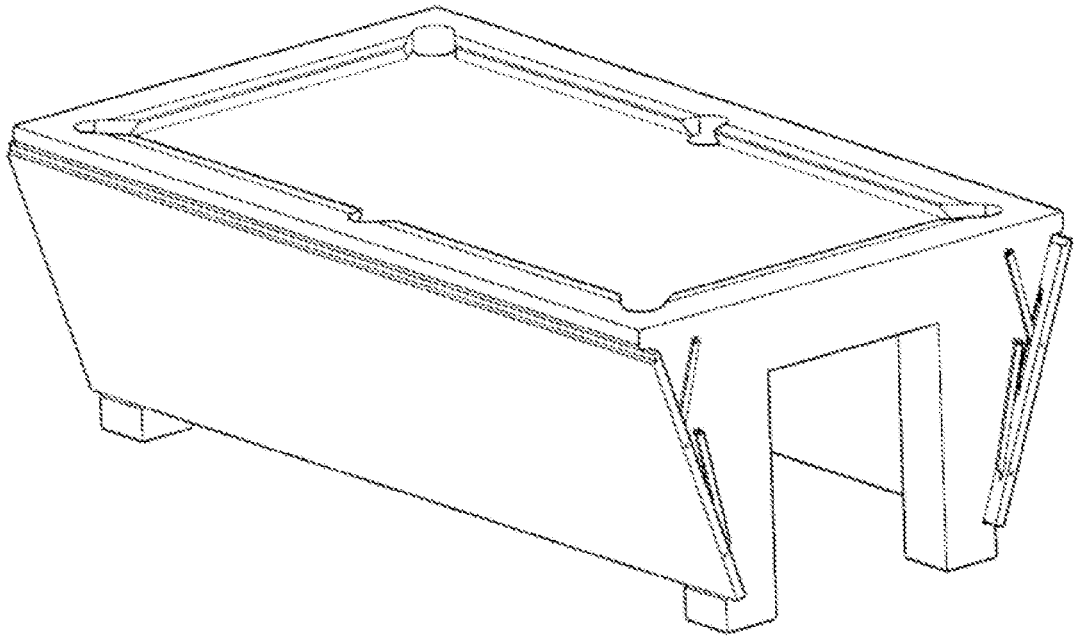
Figure 3B:
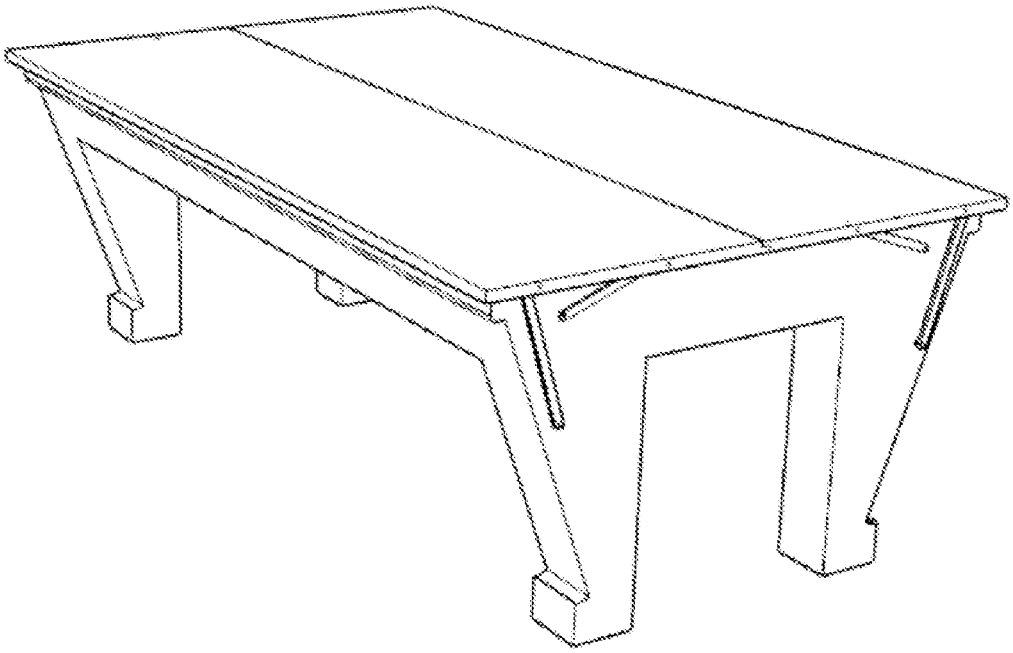
Figure 3C:
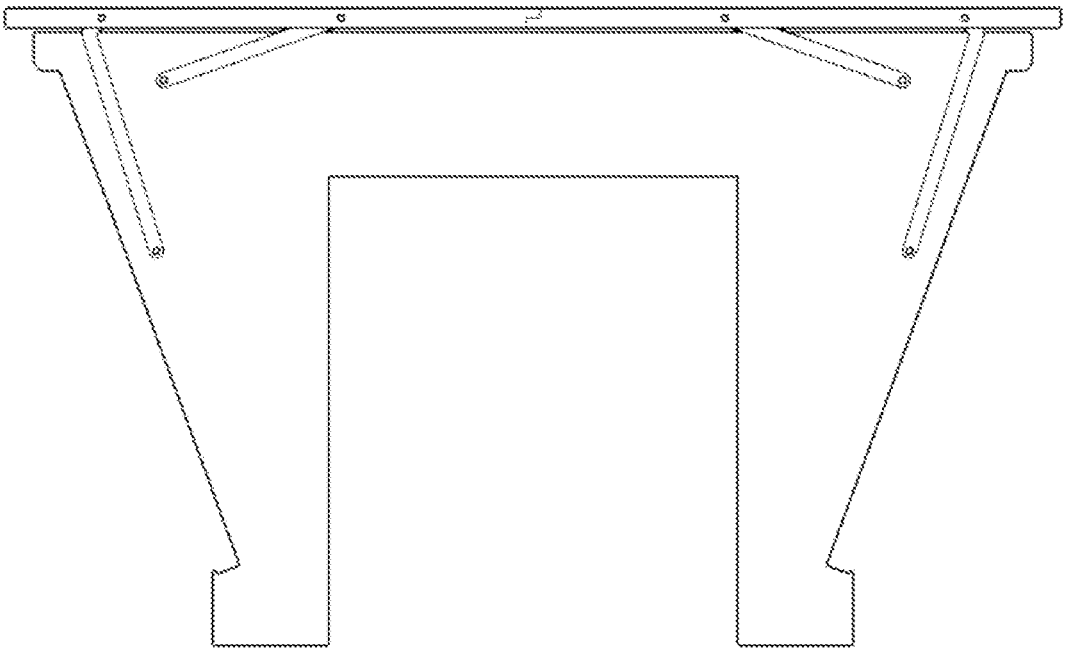
Figure 3D:
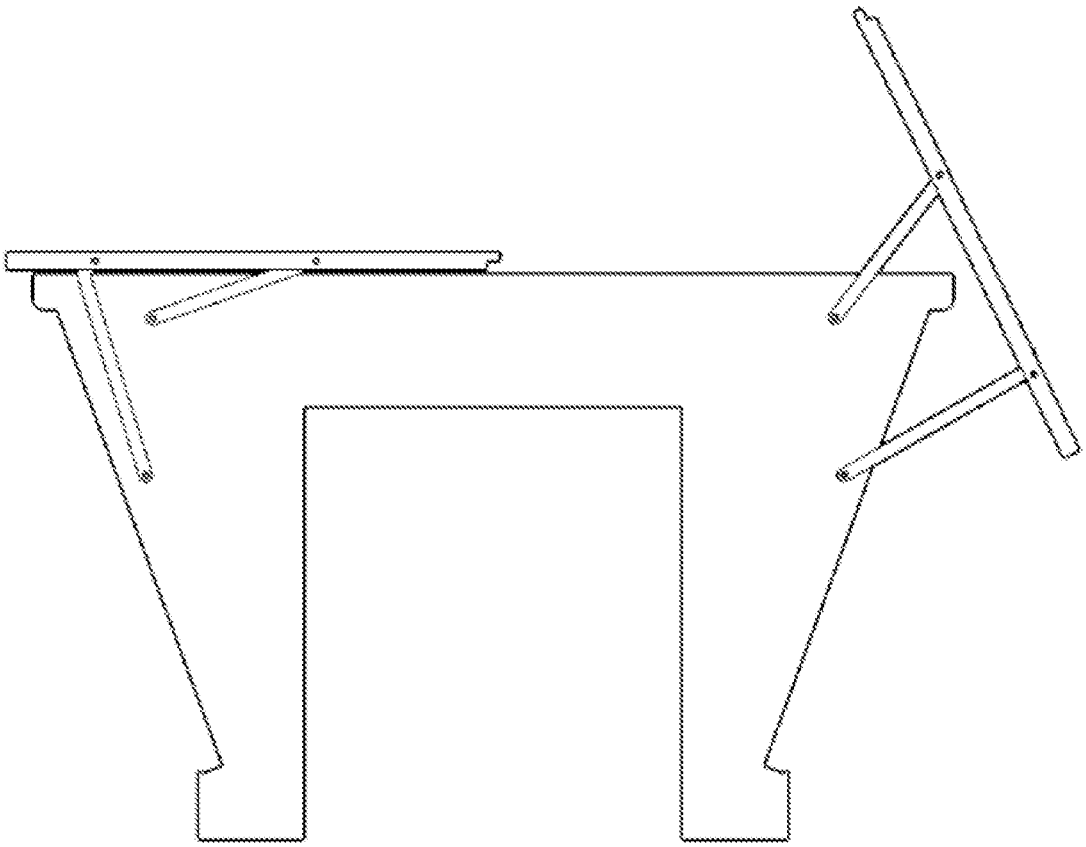
Figure 3E:
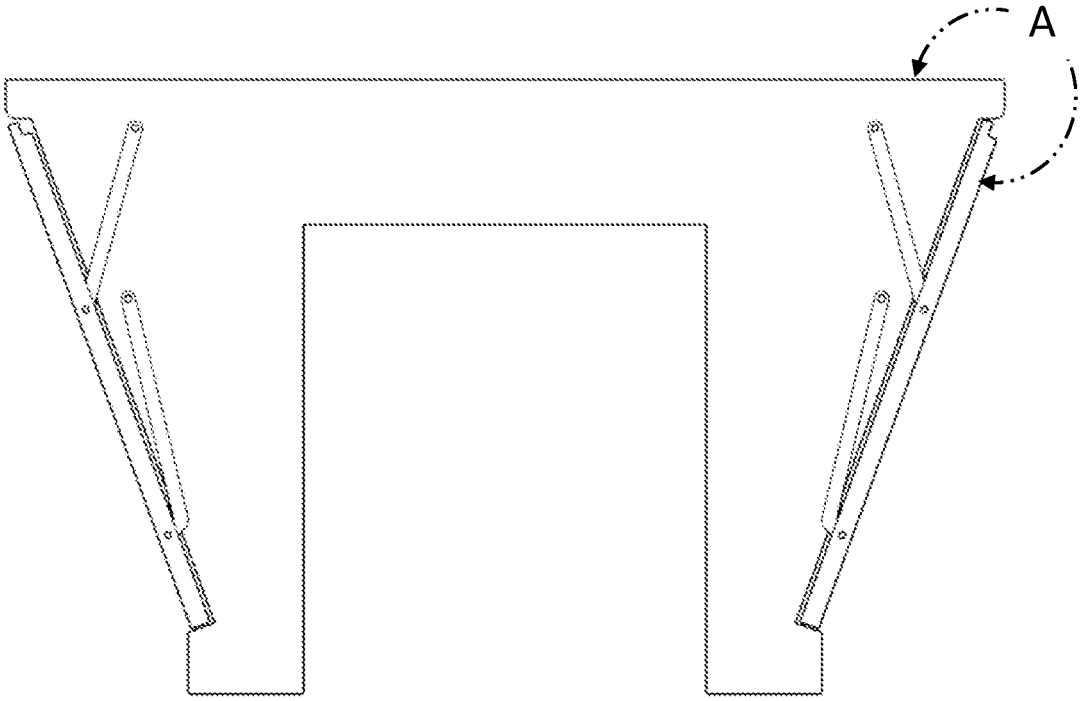
Figure 3F:
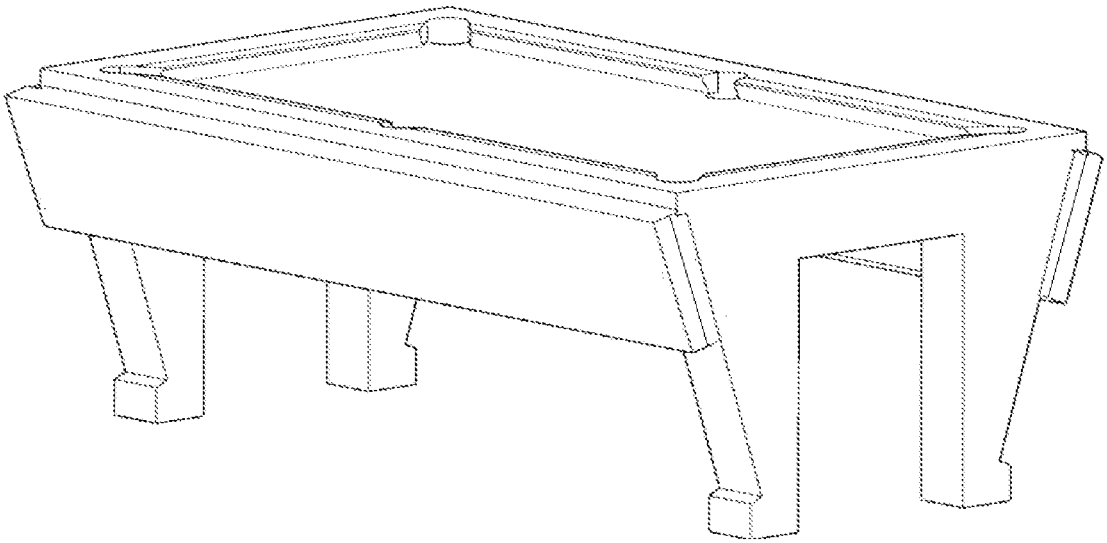
Figure 3G:
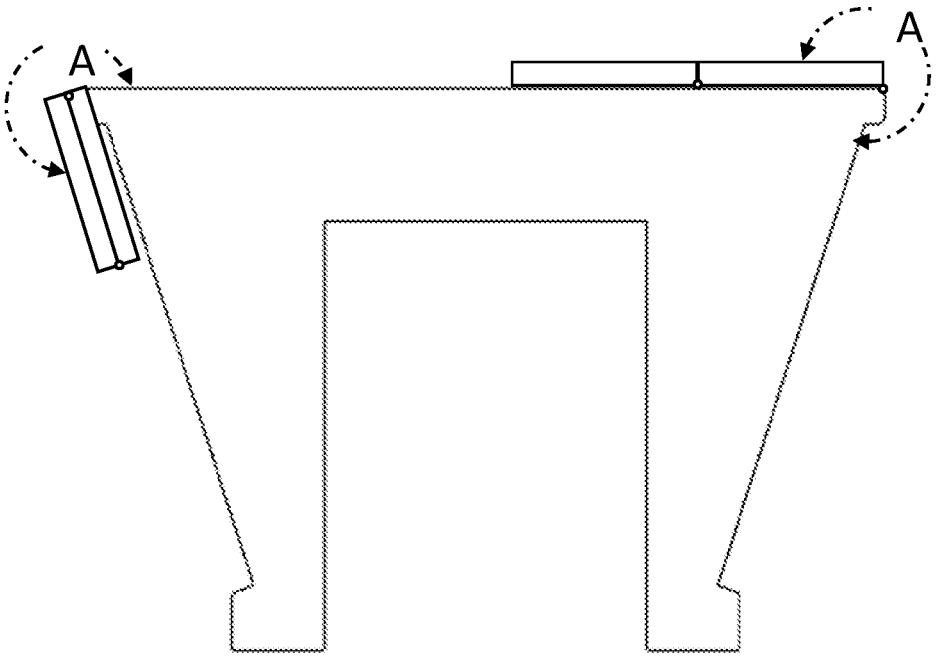
Figure 3H:
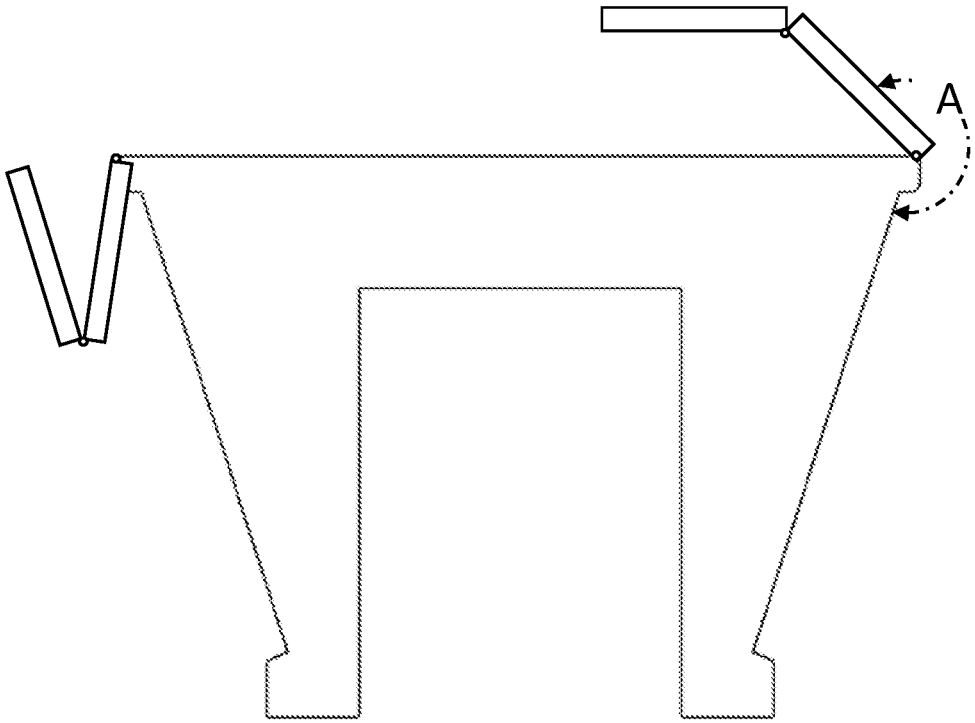
Figure 3I:
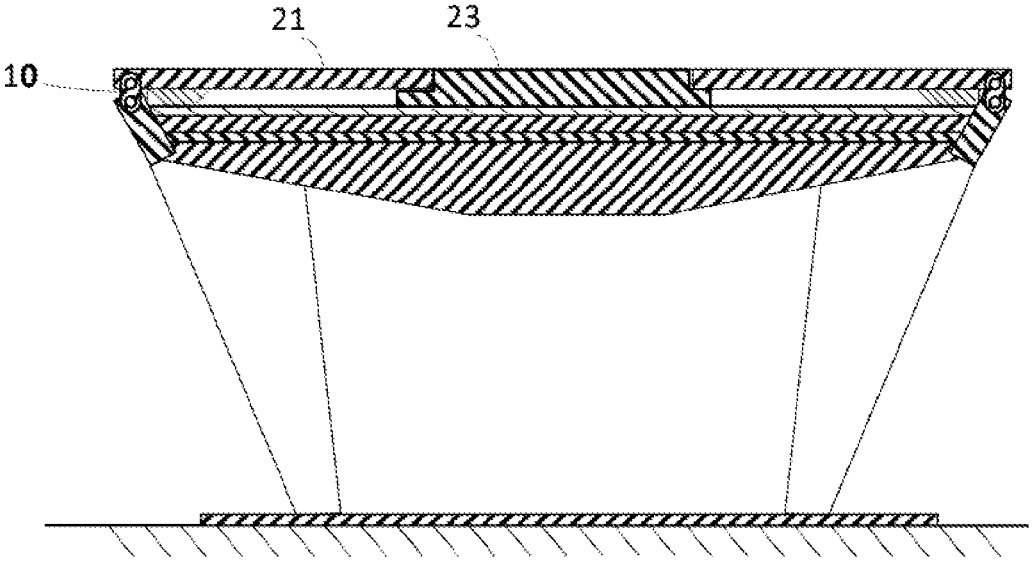
Figure 3J:
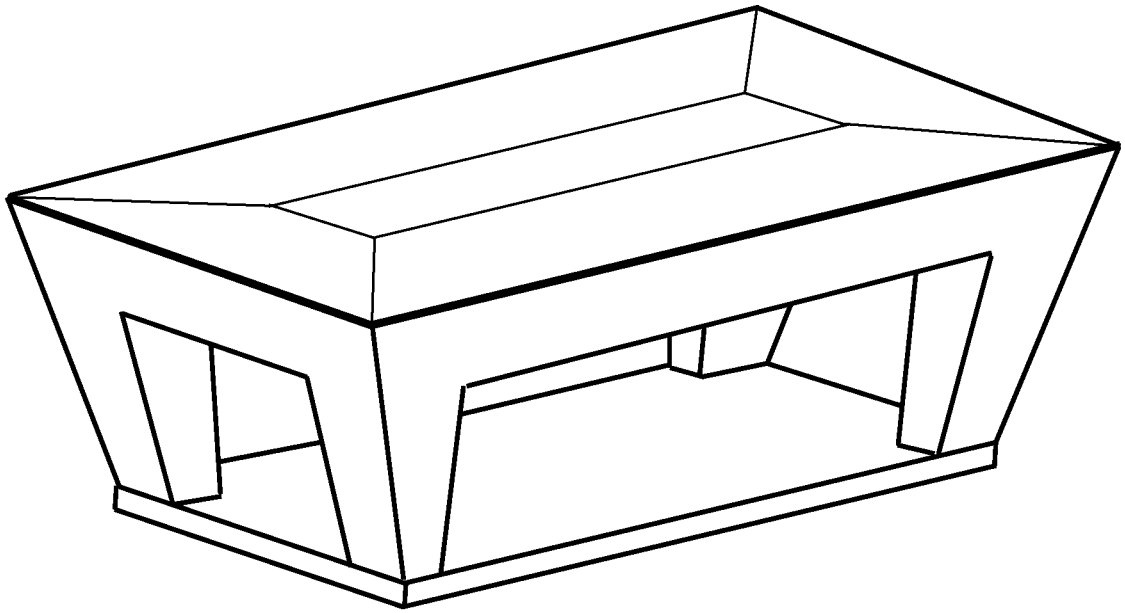
Figure 3K:
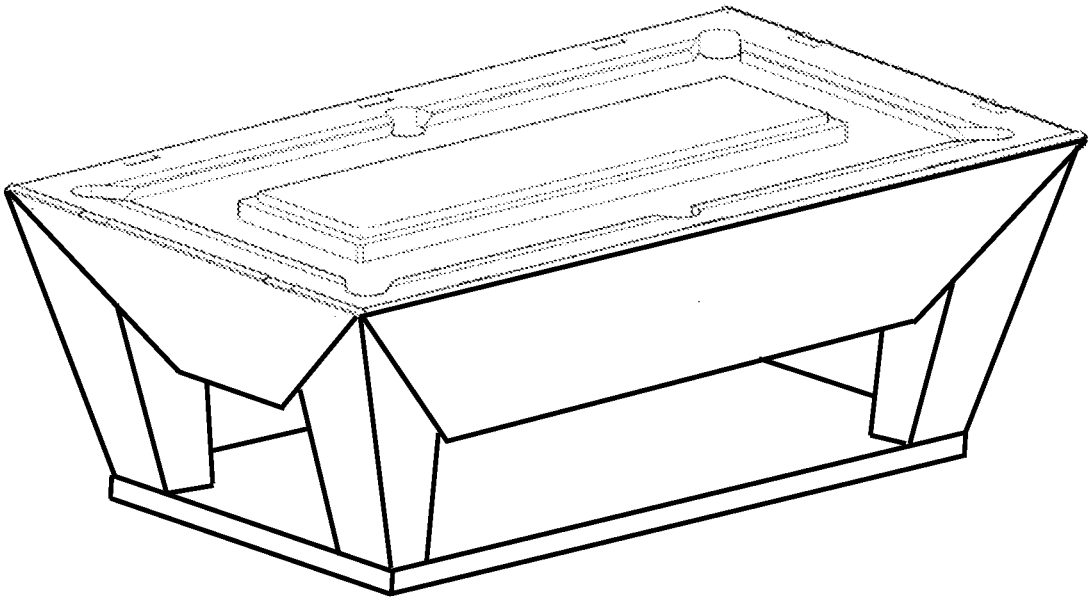
Figure 3L:
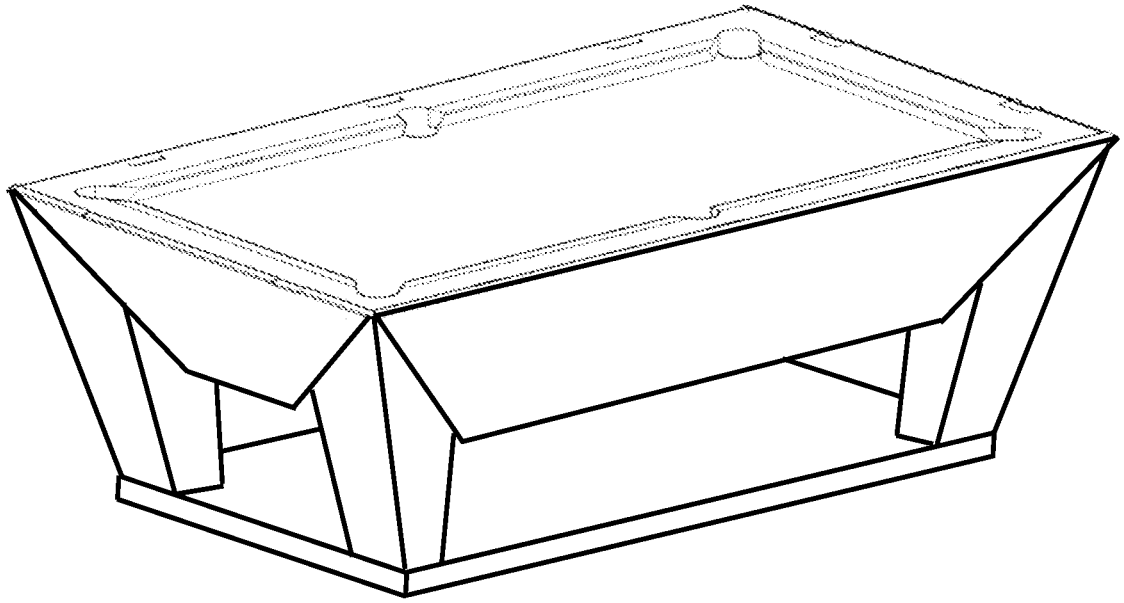
Figure 3M:
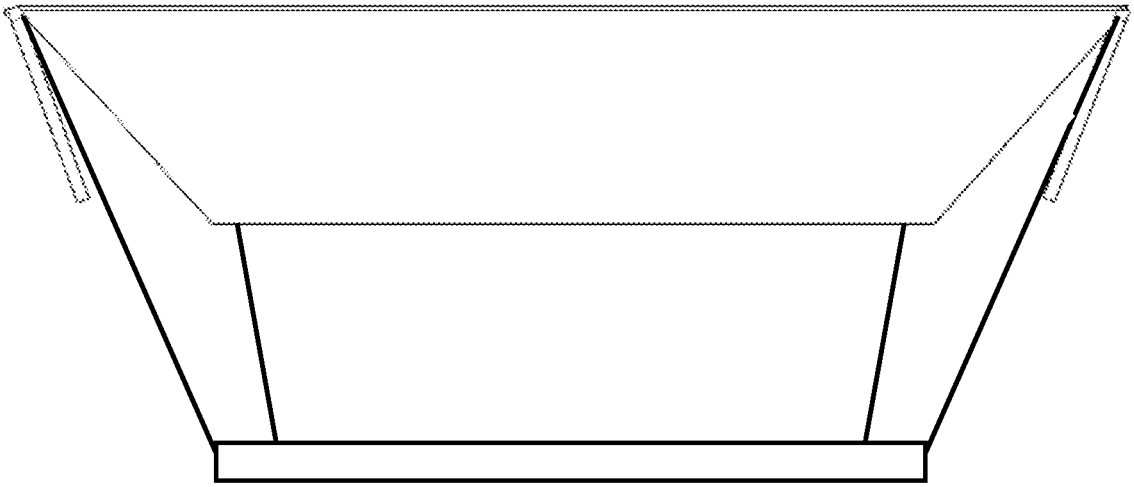
Figure 5A:
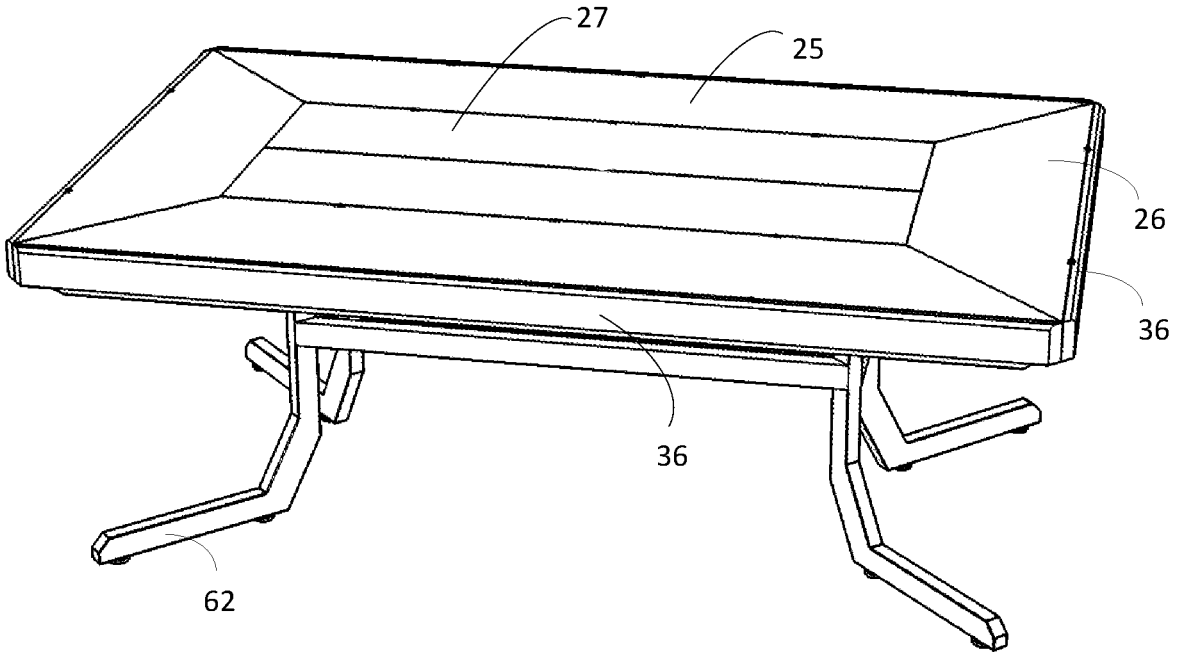
Figure 5B:
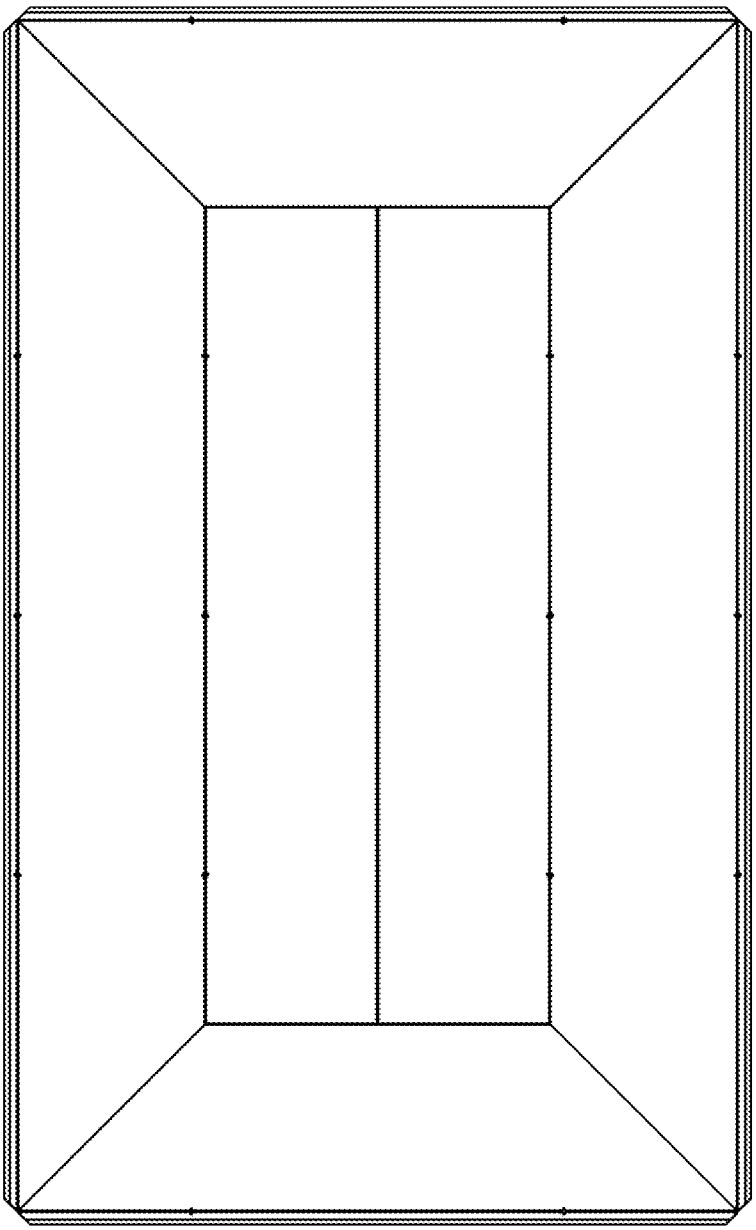

In another embodiment of the present invention the tabletop segments may be foldable. Examples of such a design are shown in FIG. 3F, FIG. 3P and FIG. 5A. A foldable design of the tabletop segments is characterized by 2 or more sub-segments that that are rotatably connected by hinges. A foldable tabletop segment design reduces the effective size of a tabletop segment in its folded state, and it can enable a more esthetically pleasing appearance of the table in the open playing position. Movably attached tabletop segments or foldable sub-segments may be affixed in place using embedded magnets, spring loaded ball locks, latches or similar devices. Noticeable about the design in FIG. 3P is that one of the foldable sub-segments of the tabletop moves from the horizontal dining position to the playing position that's vertical (Angle A about 270 degree) while a second sub-segment of the foldable tabletop is rotated further (for example by an additional 45 degree after completion of the 270 degree rotation with the first sub-segment) and therefore it is rotated by a total included angle A 270+45=315 degree. It needs to be appreciated that a foldable sub-segmented tabletop—like for example shown in FIG. 3S—may eliminate the need for more complex double pin hinge of mechanism designs. The desired angle of more than 270 degree—or preferably more than 280 degree can be achieved using multiple single hinges connecting the sub-segments. Effectively the addition of such a sub-segment and the use of multiple basic hinges may perform the same function than a more elaborate double pin hinge or mechanism design.

Furthermore, in order to enable the rotation of the tabletop segments by more than 270 degree it may be required to change the location and/or the shape of the table legs—away from the conventional location near the corners of the table—and additionally it may be required to provide sufficient clearance to complete the rotation.

In another embodiment of the present invention the conversion-top comprises both movably attached segments and removable segments. For example, in one embodiment illustrated in FIG. 3I features 4 trapezoidal shaped attached segments that can be moved from a first position to a second position through a rotating motion around the double pin hinge design shown in FIG. 7A and FIG. 7B and it features furthermore one rectangular removable segment that's not attached to the tabletop. There may be a dedicated storage space for this removable tabletop segment built in underneath the table to enable storage while the table is in playing position.

Figure 4A:
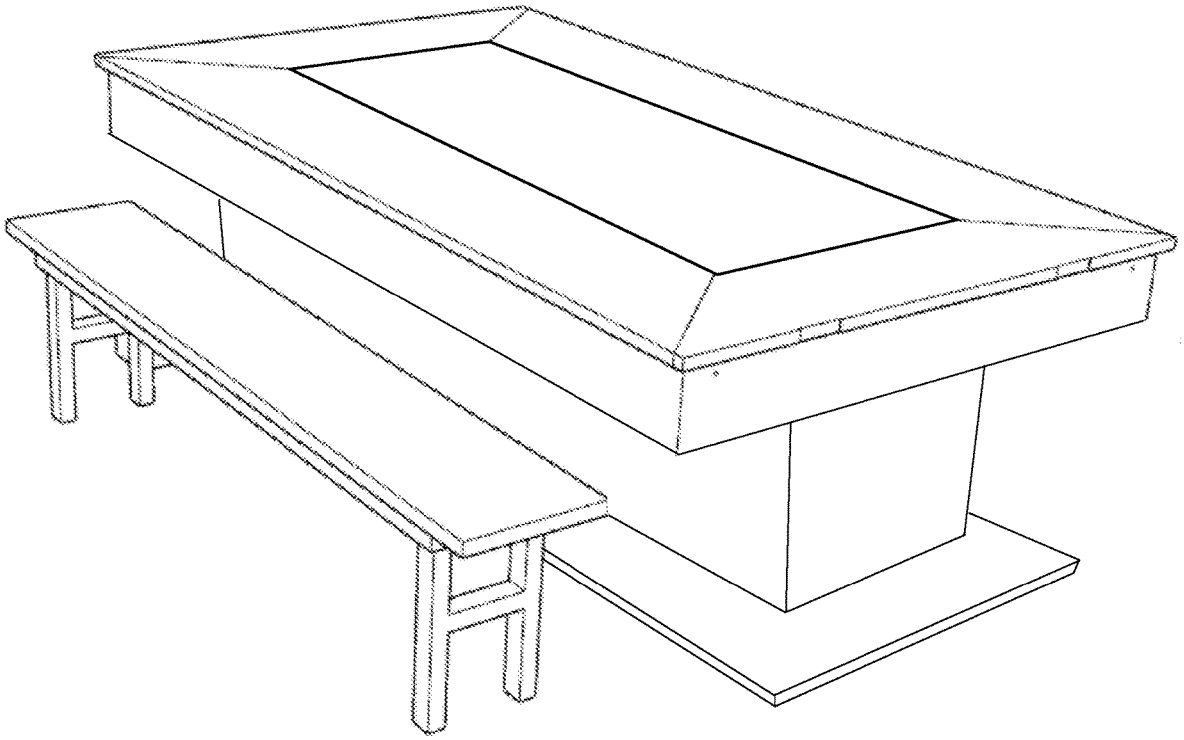
Figure 4B:
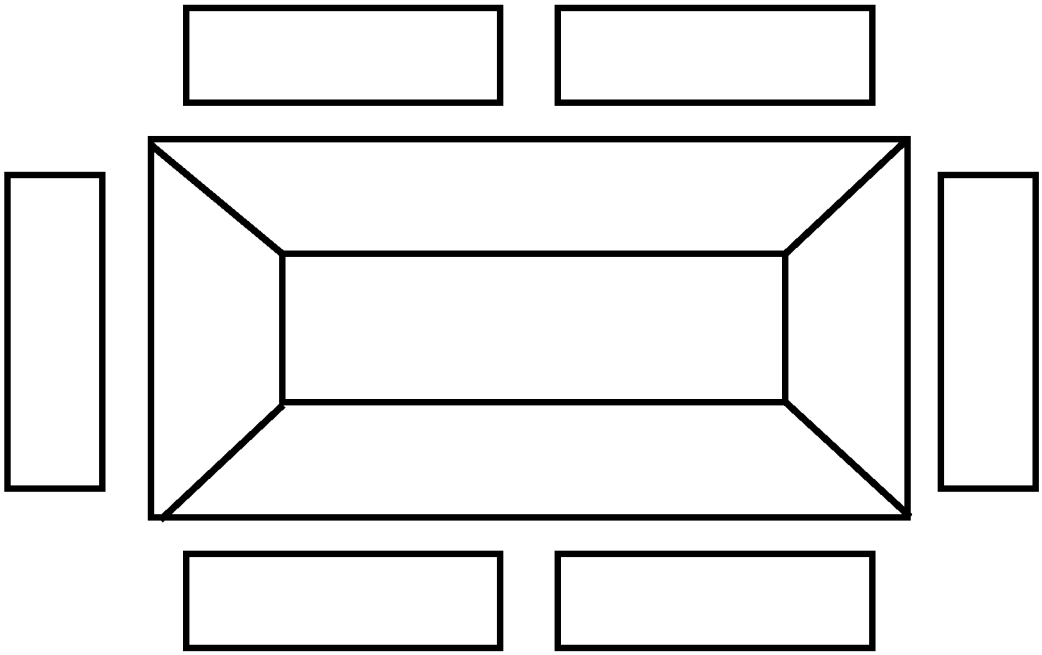
Figure 4C:
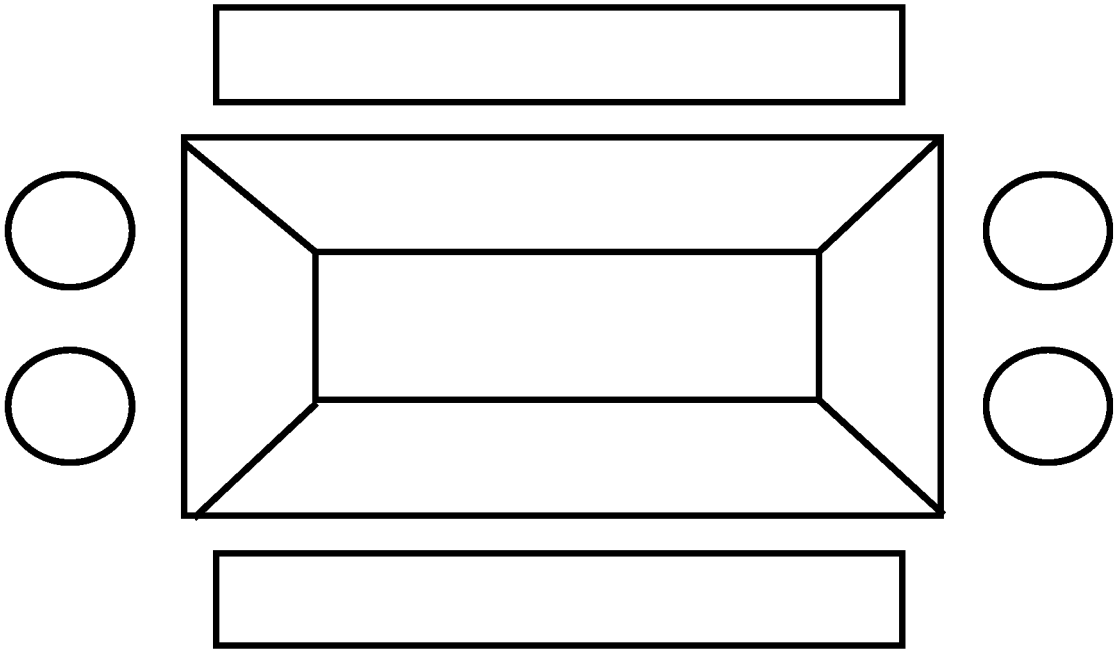
Figure 4D:
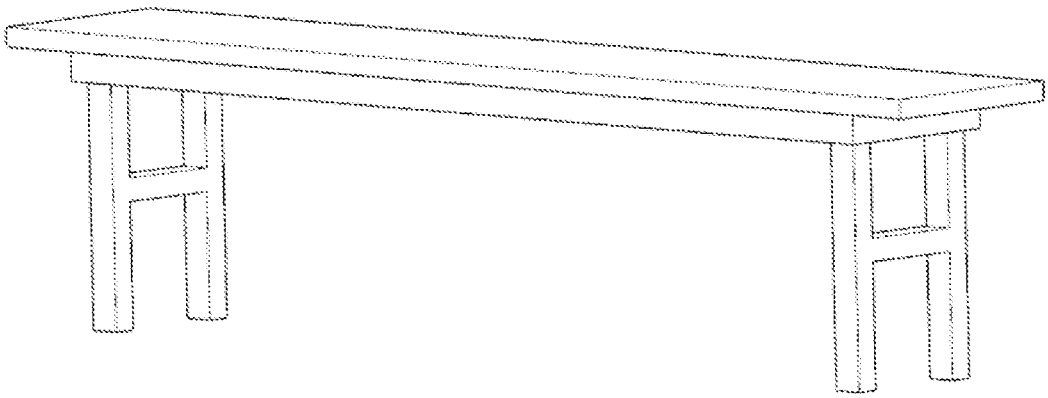
Figure 4E:
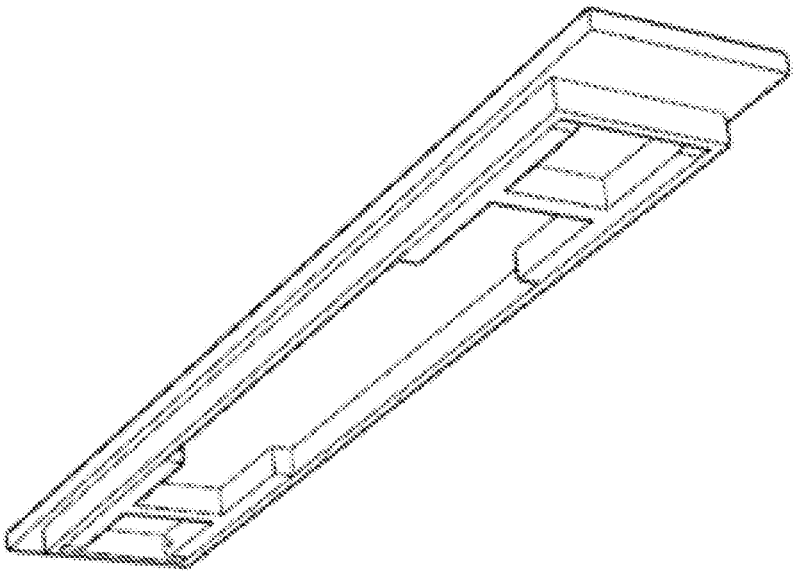

In one embodiment of the present invention the conversion-top pool table (1) may be combined with custom fitted seats (100), such as benches, chairs or stools to form a complete dining set (200). The seats may be designed to have a height adopted to the height of the table, as described earlier and furthermore feature foldable or collapsible features to enable a more compact size for storage underneath the table (1). For example, in one embodiment of the invention, shown in FIG. 4B the dining set (200) may include 6 benches, each wide enough to offer space for 2 average size adults. The benches may feature foldable legs (120) and the foldable legs may be held in the fully open position or second fully closed position by the use of springs or latches. The dining pool table (1) of dining set (200) may furthermore offer dedicated space to store these benches (100) in their fully closed position underneath the upper table assembly (19). Different variations of different seating arrangements including stools, chairs and benches, featuring foldable or rigid leg constructions may be combined to form new dining sets arrangements. In one embodiment of the invention the seats will be hanging or be supported underneath the upper table assembly (19) without resting on the floor. Ideally the seats will be located underneath the upper table assembly in a way that they cannot be seen from the outside to provide an esthetically pleasing appearance.

Figure 3N:
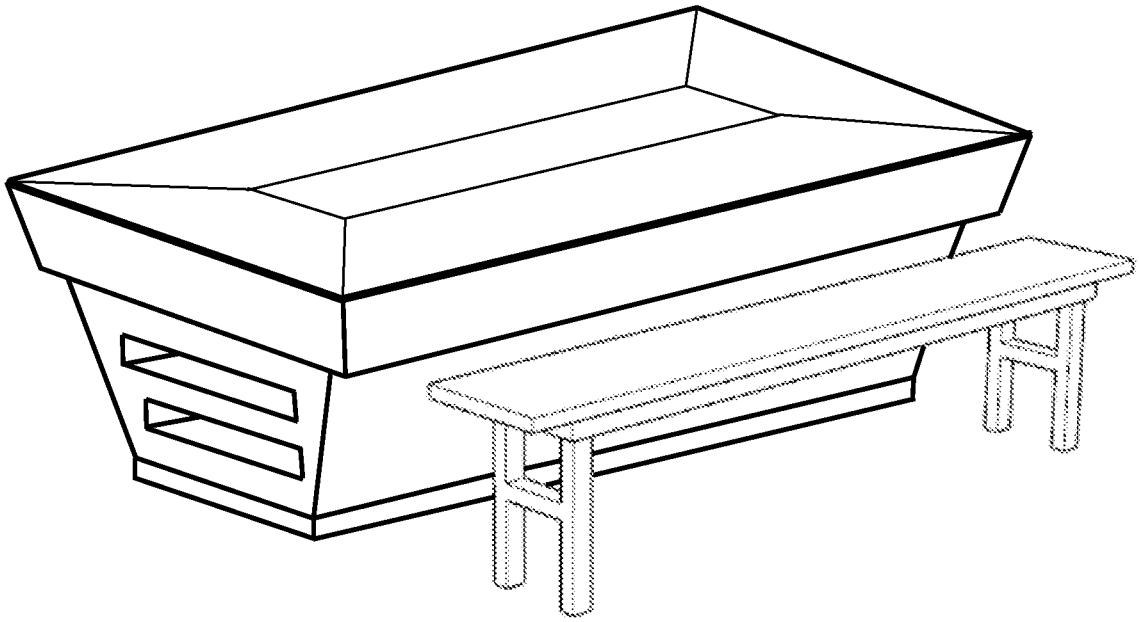
Figure 3O:
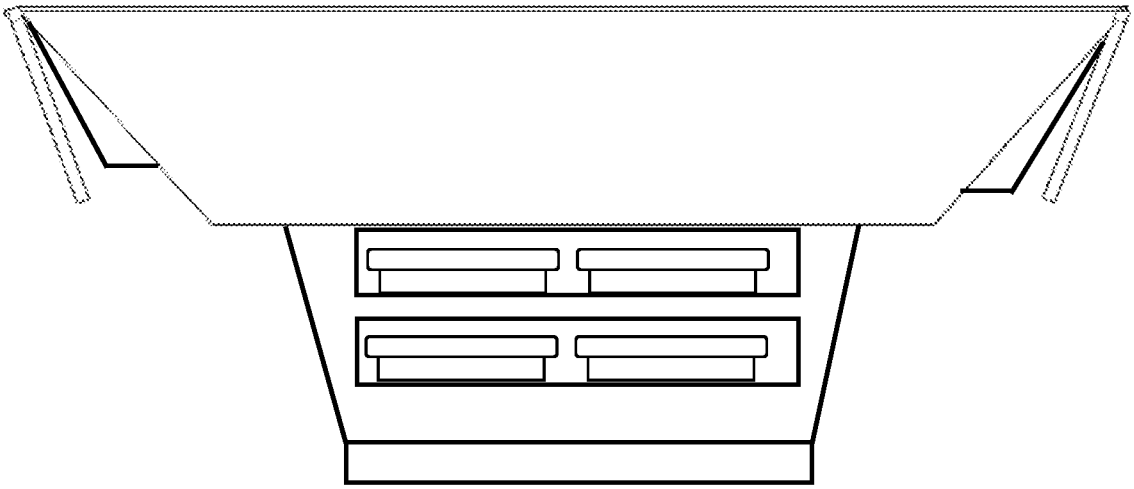
Figure 3P:
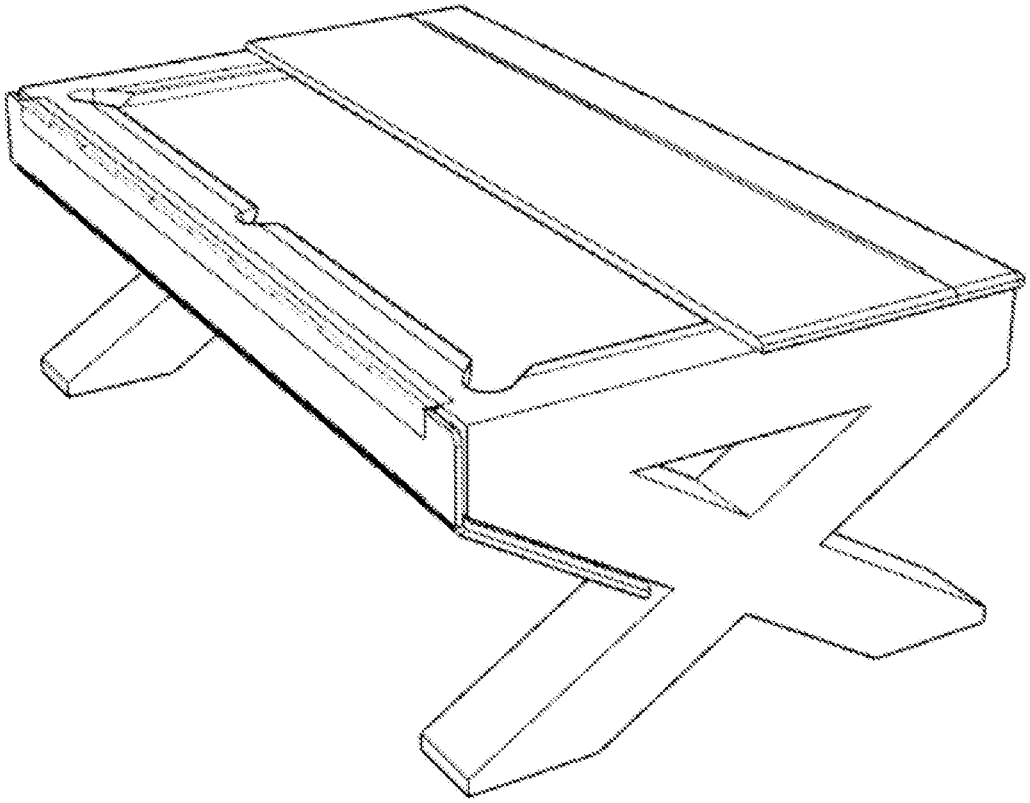
Figure 3Q:
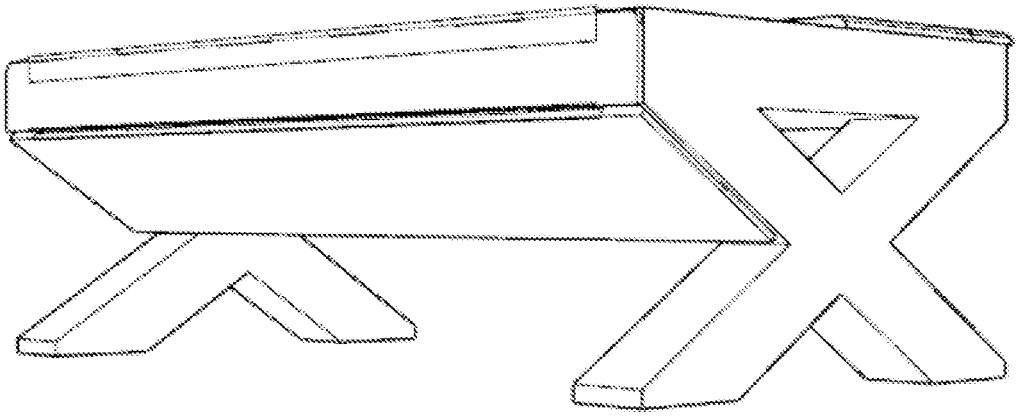

In a different embodiment—as shown in FIG. 3N—the dining pool table is designed with a mono-leg. Instead of 2 or 4 table legs, the table is supported by what appears like a monolithic support structure. Although this support may be fabricated from structural support elements and cover panels on the outside, the mono-leg design provides the appearance of a single center leg supporting the table. In the specific execution of FIG. 3N, the support structure also provides storage compartments where benches in their folded position may be inserted underneath the table. The accessibility of these storage compartments may be designed from the short side or the long side of the table.

It needs to be noted that for some table leg designs, depending on the width of the footprint where legs contact the floor (W1 in FIG. 2A), it may be necessary to attach a base plate (70) under the table legs to prevent the table from tipping. Tipping could occur for example when one or more persons choose to sit on the outside edge of the table. In such a design the width W2 of the base plate would be wider than the width W1, but preferable not wider than the width W3 of the tabletop.

Alternatively, heavy material may be chosen, or extra weight may be added preferably below the center of gravity of the table, for example to the legs, to prevent the table from tipping.

A preferred execution of the present invention is shown in the series of FIGS. 5 (5A through 5G). The dining pool table is supported by outrigger legs (62). Such legs may connect to the upper table assembly at a relatively narrow width, providing space for the tabletop segments to fold underneath the upper table assembly, to be stored away while the table is in its playing position. The outrigger legs are an alternative means to address the above-described risk of the table tipping, since the outriggers provide a wider footprint similar to the base plate (70) described above.

The table of FIGS. 5 (5A through 5G) furthermore features a combination of different foldable tabletop segments in a unique configuration of 4 rotatable aprons (36), 2 long trapezoidal tabletop segments (25), 2 short trapezoidal segments (26) and 2 rectangular tabletop segments (27). The 2 rectangular tabletop segments (27) are rotatably attached to 2 longer trapezoidal tabletop segments (25) that are rotatably attached to 2 of the rotatable aprons (26) that are rotatably attached to the long sides of the pool table, creating a foldable tabletop arrangement. Additionally, the short trapezoidal segments (26) are attached to 2 other rotatable aprons (36) that attach to the short side sis of the pool table.

Figure 5C:
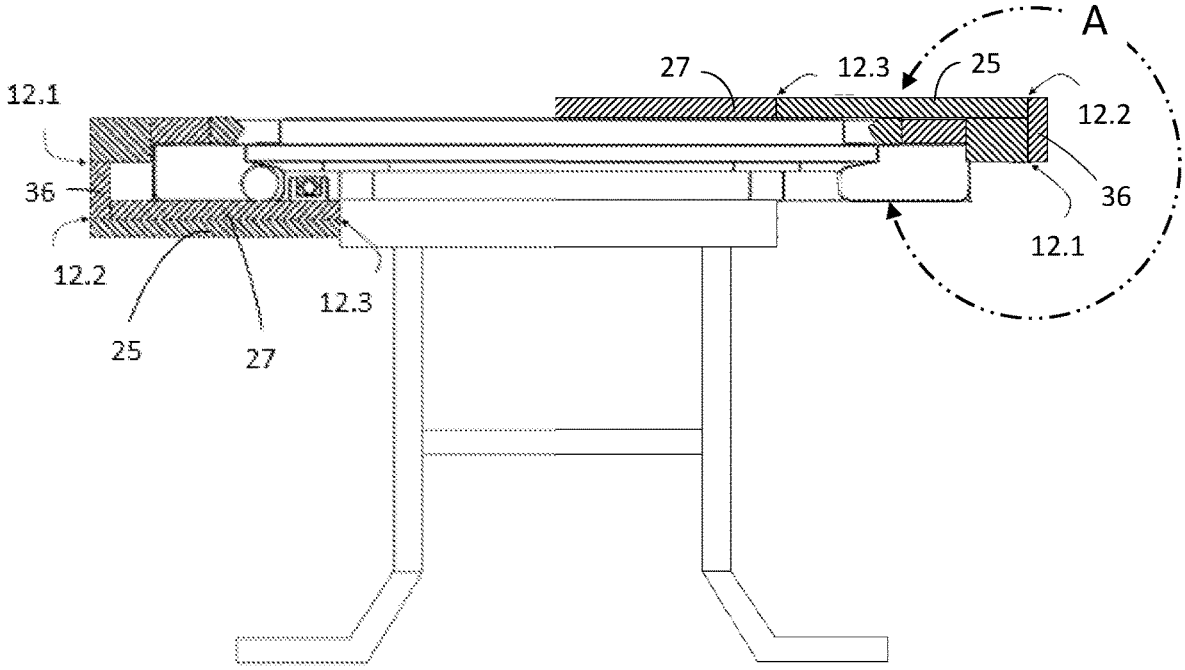
Figure 5D:
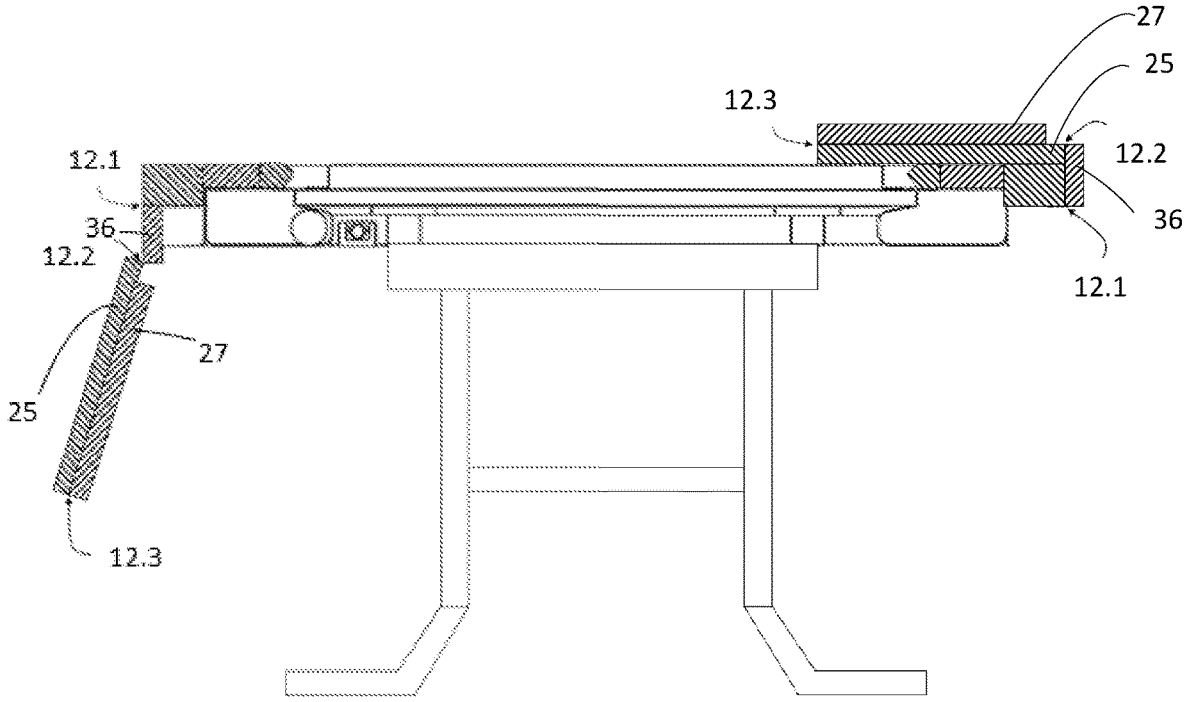

FIGS. 5C and 5D, illustrate different positions of the table top segments of converting the table. The various rotatable attachments mentioned before are featuring hidden hinges, such as described before. Their locations are indicated by arrows 12.1, 12.2 and 12.3 in FIGS. 5C and 5D. It needs to be appreciated that the included angle of the rotation between the first position (Playing position shown in the left half of FIG. 5C) and the $2^{nd}$ position (Dining position shown in the right half of FIG. 5C) is different for each of the 3 movably attached segments that are part of the converting sequence. For example, the rotatable apron 36 is connected at hinge point 12.1 with the upper table assembly and will rotate by an angle of about 180 degree when the tabletop is converted. The long trapezoidal tabletop segment (25) is connected at hinge point 12.2. to the rotatable apron (36). While the motion at hinge point 12.2 will also be limited to about 180 degree, the total rotation of the long trapezoidal tabletop segment (25) will be about 360 degree (as the composite motion includes a rotation by about 180 degree around hinge point 12.1 and additional 180 degree around hinge point 12.2). Finally, the rectangular tabletop segment (27) is connected via hinge point 12.3 to the long trapezoidal tabletop segment (25). The composite motion for the rectangular tabletop segment (27) to move from the first position (playing) to the $2^{nd}$ position (dining) includes a total included angle of about 540 degree. 180 degree when segment 27 folds around hinge point 12.3 onto segment 25, an additional 180 degree when segments 25 and 27 together rotate about hinge point 12.2, and finally another 180 degree when segments 25 and 27 together with the rotatable apron 36 rotate around hinge point 12.1. Therefore, the total included angle of rotation for segment 27 includes 540 degree.

While different designs require different number of hinges and rotatable segments as well as different included angles of rotation, the common denominator of the described invention is a rotatably attached tabletop where at least one rotatable segment rotates by a total included angle—previously referred to as composite motion—of more than 280 degree, and preferably more than 315 degree.

Combination of industrial magnets and ferromagnetic metal inserts that may be embedded in the tabletop segments and the support structure of the table to hold the tabletop segments in their folded position under the upper table assembly while the table is in playing position. Alternatively, a latching mechanism may be deployed to secure the tabletop segments in place. A ferromagnetic metal insert in the rectangular tabletop segment (27) may also serve a secondary purpose to enable initiating the opening of the tabletop segments when the table is in the dining position. A magnetic removable handlebar could be used to engage with the ferromagnetic metal insert to lift the rectangular tabletop segment (27) to create an opening for a hand to reach in and complete the conversion.

Figure 5E:
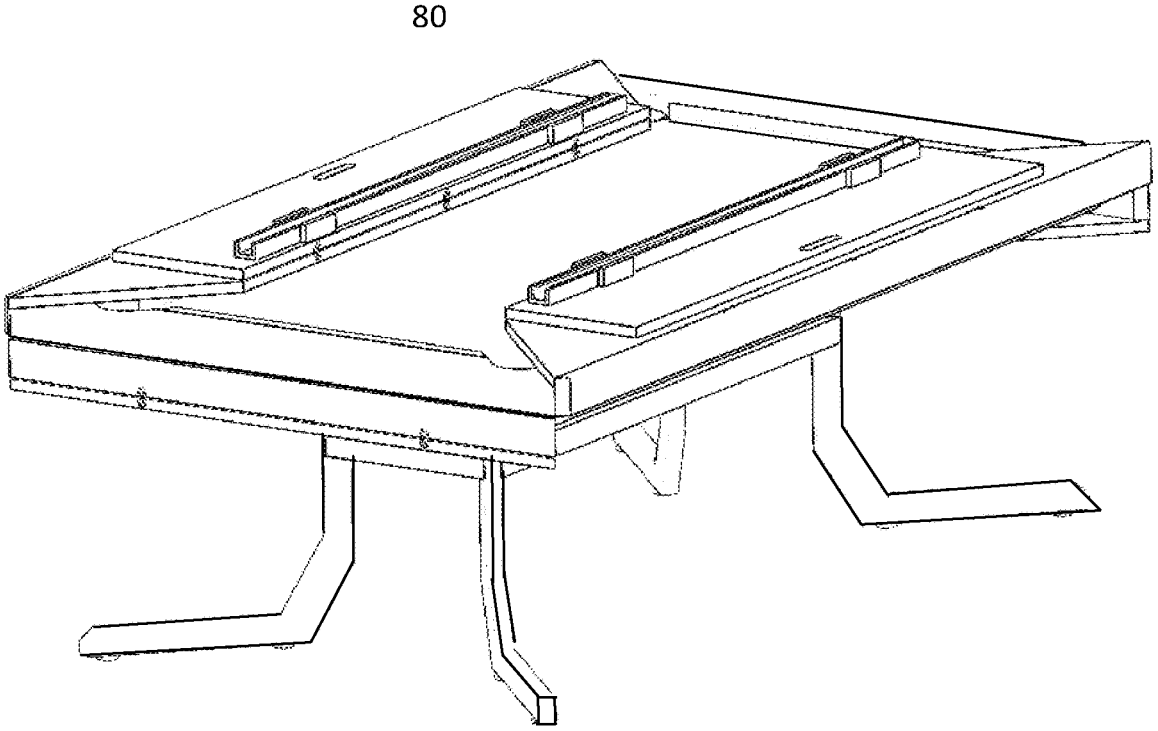

FIG. 5E—and the right half of FIG. 5D—shows the table in partially open position, with the short trapezoidal tabletop segments (26) already folded under the table and locked in the playing position, the rectangular tabletop segments (27) are folded onto the long trapezoidal tabletop segments (25), that are still in the dining position on top of the table, waiting to be rotated and locked under the table to open up the playing surface. FIG. 5E also shows a pool cue storage rack (80) mounted to the underside of the rectangular tabletop segment (27). The storage rack serves the secondary purpose of supporting the rectangular tabletop segment (27) while the table is in the dining position.

Figure 5F:
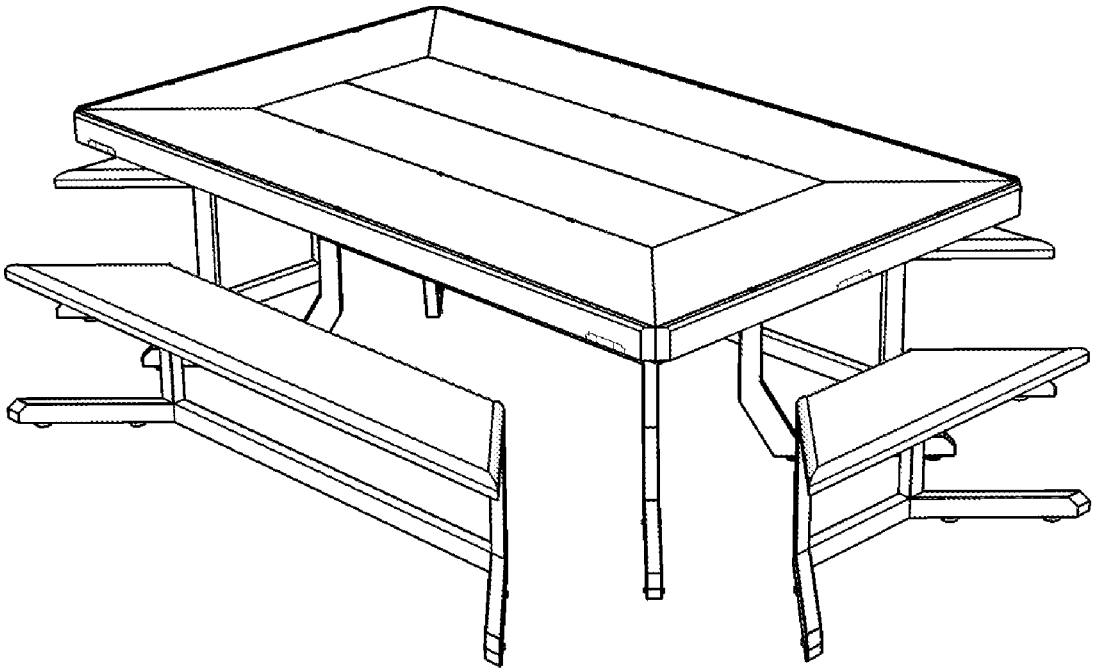
Figure 5G:
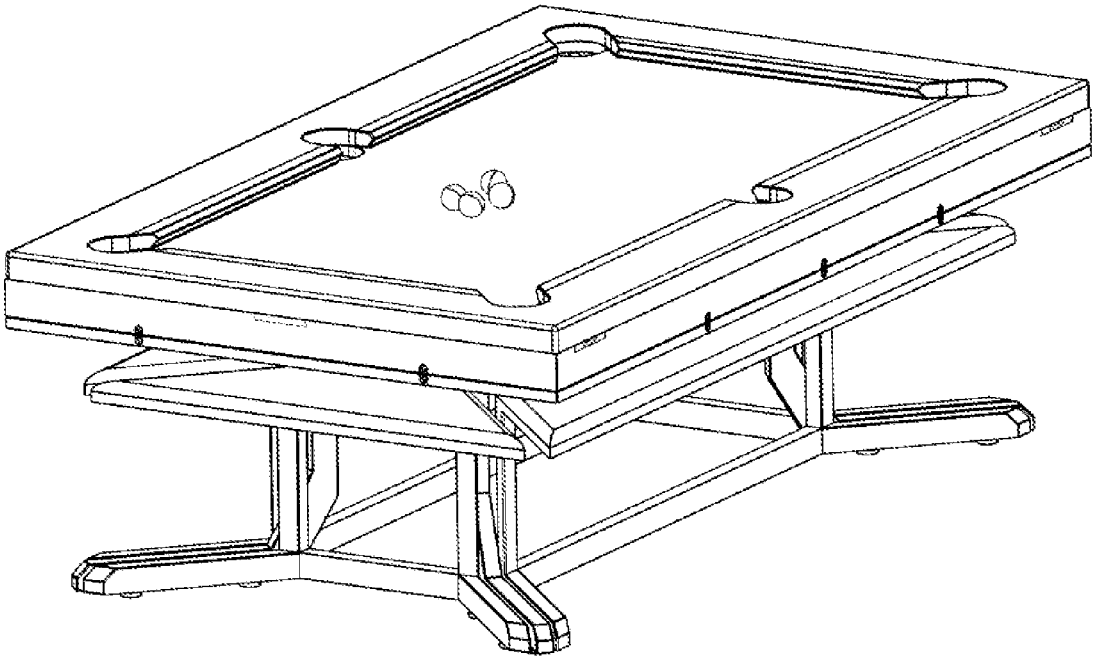

FIG. 5F shows an isometric view of the dining set (200) in the dining position. It features the pool table (1) and 4 benches (100) that correspond in shape to the trapezoidal tabletop segments. This allows the benches to nest right between the outrigger legs when pushed underneath the table for the playing position as shown in FIG. 5G.

Figure 6:
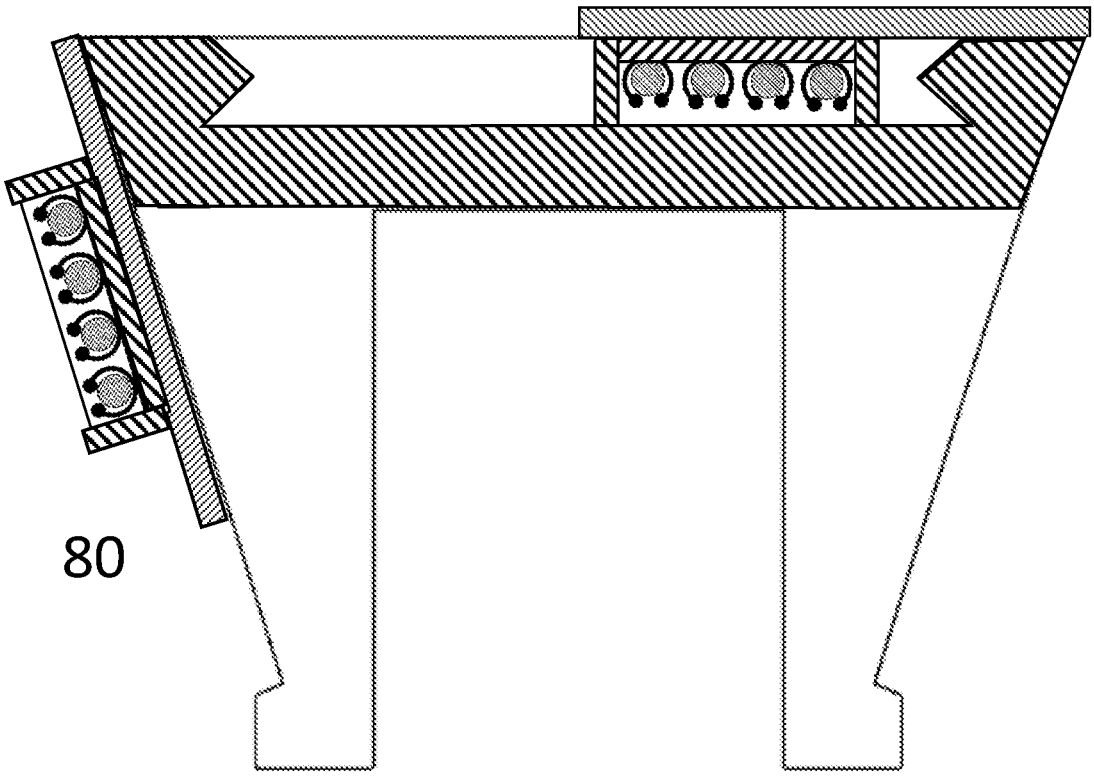

The embodiment of FIG. 6 shows an illustration of a pool cue storage rack (80) that's integrated into the dining pool table. While some people may prefer a wall mounted storage rack, the present invention includes a design where the storage rack is mounted to the underside of at least one of the tabletop segments. As such the pool cues are stored invisibly under the tabletop when the table is in the dining position and but will be accessible when tabletop segments are folded down. The cue rack may furthermore support the weight of the tabletop segments when folded into the dining position.

It needs to be appreciated that the movable and foldable tabletop designs and other improvements described previously are not limited to application for convertible pool dining tables, but instead may provide benefits for other game tables designs for example, combinations of dining tables with shuffleboard, table tennis, roulette, air hockey or other games. They may furthermore not be limited to the dual use of dining see and playing games, but may generally be considered for dual purposed tables, featuring 2 distinct workings surfaces. For example, the table may be used as a table with a dining surface and an underneath located storage compartment for table cloths, kitchen utensils or other items could be stored underneath the tabletop surface.

It needs also be appreciated that depending on the specific dimensions of these tables, some of the described embodiments of movable tabletop arrangements may be more suitable than others. For examples designs of tabletop segments that only attach to the long side of the table, such as show in FIG. 3A may be particularly suitable for tables with a large length to width ratio, like for example shuffleboard tables. For other games table designs where tabletop segments attach to all 4 sides of a table may be preferable. The concepts described before may also be considered for polygon shaped tables such a pentagon, hexagon or octagon tables. As such the concepts described are not limited to rectangular table designs.

What is claimed is:

1. A game table comprising:

a support structure, at least one playing surface, at least one rotatable apron, at least one table top segment, and at least two sets of hinges, wherein said at least one rotatable apron is movably attached to said support structure using a first set of hinges from the at least two sets of hinges, and wherein said at least one table top segment is movably attached to said rotatable apron using a second set of hinges from the at least two sets of hinges, allowing the at least one table top segment to move from a first table top position to a second table top position, wherein said at least one rotatable apron and said at least one table top segment are configured to move independently from each other, and wherein the first table top position is characterized as a dining position and the second table top position is characterized as a playing position, and wherein said first table top position is defined by the at least one table top segment and the second set of hinges being located substantially above the at least one playing surface, and wherein said second table top position is defined by the at least one table top segment and the second set of hinges being located substantially below the at least one playing surface.

2. The game table of claim 1, wherein the total included angle between the first table top position and the second table top position is at least 315 degree.

3. The game table of claim 1, wherein said at least one rotatable apron is configured to pivot by an angle of about 180 degree.

4. The game table of claim 1, furthermore comprising a second table top segment and a third set of hinges, wherein said at least one table top segment includes a second table top segment, wherein the second table top segment is attached to said at least one table top segment using said third set of hinges.

5. The game table of claim 1, wherein said at least one table top segment is detachable.

6. The game table of claim 1, furthermore comprising a pool cue storage rack, wherein the pool cue storage rack is attached to the underside of the at least one table top segment when the at least one table top segment is in said first table top position, and wherein the pool cue storage rack is resting on said at least one playing surface to support the at least one table top segment when the at least one table top segment is in said first table top position.

7. The game table of claim 1, furthermore comprising a dedicated storage space for seating and at least one chair and/or bench, wherein said storage space is an integral part in said support structure, and wherein said storage space is located underneath said at least one playing surface and wherein said seat when located in the storage space is supported by said support structure.

8. A game table comprising:

a support structure, a playing surface, at least one chair and/or bench, a dedicated storage space for said at least one chair and/or bench, and at least one table top segment, and at least one double pin hinge, wherein said at least one table top segment is movably attached to the support structure using the double pin hinge and wherein the at least one double pin hinge allows the at least one table top segment to move from a first table top position to a second at least one position, and wherein the total included angle between the first and the second table top positions is at least more than 270 degree, and wherein said storage space is an integral part in said support structure and wherein said storage space is located underneath said playing surface and wherein said at least one chair and/or bench when located in the storage space is supported by said support structure.

9. The game table of claim 8, further including at least two single hinges and a sub-segment, wherein said at least one double pin hinge is defined by connecting said at least two single hinges with said sub-segment.

10. The game table of claim 8, wherein said at least one table top segment includes a second table top segment, and wherein said second table top segment is movably attached to said at least one table top segment and can rotate independently of said at least one table top segment by an angle ranging from about zero to about 180 degree.

11. The game table of claim 10, furthermore comprising a pool cue storage rack, wherein the pool cue storage rack is attached to the underside of the at least one table top segment when the at least one table top segment is located in said first table top position, and wherein the pool cue storage rack is resting on said playing surface to support the at least one table top segment when the at least one table top segment is located in said first table top position.

12. A game table comprising:

a support structure, a playing surface, at least four rotatable aprons, an upper table assembly featuring at least four sides and having a substantially rectangular shape, an outer perimeter being defined by the at least four sides, and furthermore featuring at least four table top segments, wherein each of said at least four table top segments is attached to one of the at least four sides of the upper table assembly allowing each of the at least four table top segments to move from a first table top position characterized as a dining position to a second table top position characterized as a playing position, and wherein said at least four table top segments are characterized by being located substantially inside the outer perimeter of the upper table assembly and above the playing surface in the dining position and wherein said at least four table top segments are characterized by being located substantially inside the outer perimeter of the upper table assembly and below the playing surface when at least four table top segments are in the playing position.

13. The game table of claim 12, furthermore comprising a pool cue storage rack, wherein the pool cue storage rack is attached to the underside of at least one of the at least four table top segments when the at least four table top segments are located in said first table top position, and wherein the pool cue storage rack is resting on said playing surface to support at least one of the at least four table top segment when the at least four table top segments are located in said first table top position.

14. The game table of claim 12, furthermore comprising a dedicated storage space for seating, and at least one chair and/or bench, wherein said storage space is an integral part in said support structure, wherein said storage space is located underneath said playing surface, and wherein said at least one chair and/or bench when located in the storage space is supported by said support structure.

* * * * *